US011795703B2

(12) United States Patent
Ghazalah et al.

(10) Patent No.: US 11,795,703 B2
(45) Date of Patent: Oct. 24, 2023

(54) ELEVATOR TRENCH DRAIN

(71) Applicant: Zurn Industries, LLC, Milwaukee, WI (US)

(72) Inventors: Karam Ghazalah, Milwaukee, WI (US); Christopher J. Say, Waterford, PA (US)

(73) Assignee: ZURN INDUSTRIES, LLC, Milwaukee, WI (US)

( * ) Notice: Subject to any disclaimer, the term of this patent is extended or adjusted under 35 U.S.C. 154(b) by 0 days.

(21) Appl. No.: 17/239,466

(22) Filed: Apr. 23, 2021

(65) Prior Publication Data

US 2022/0243484 A1 Aug. 4, 2022

Related U.S. Application Data

(60) Provisional application No. 63/145,802, filed on Feb. 4, 2021.

(51) Int. Cl.

| | |
|---|---|
| ***E04F 17/00*** | (2006.01) |
| ***E04F 19/10*** | (2006.01) |
| ***B66B 13/30*** | (2006.01) |

(52) U.S. Cl.

CPC ..... *E04F 17/00* (2013.01); *B66B 13/301* (2013.01); *E04F 19/10* (2013.01)

(58) Field of Classification Search

CPC ..... B66B 13/301; E04F 17/00; E04F 19/10; E03F 2005/068; E03F 5/06; E03F 5/047

USPC ..... 52/302.1

See application file for complete search history.

(56) References Cited

U.S. PATENT DOCUMENTS

| | | | | |
|---|---|---|---|---|
| 2,363,567 | A | 11/1944 | Blakeman | |
| 2,779,430 | A | 1/1957 | Sisk | |
| 2,889,928 | A | 6/1959 | Sisk | |
| 3,040,895 | A | 6/1962 | Sisk | |
| 3,246,582 | A * | 4/1966 | Wade | E03F 5/0407 210/164 |
| 3,455,059 | A | 7/1969 | Evans, III | |
| 3,990,469 | A * | 11/1976 | Ralston | E03F 5/0407 52/288.1 |
| 4,067,072 | A | 1/1978 | Izzi | |
| D259,950 | S | 7/1981 | Henry | |
| 4,321,713 | A * | 3/1982 | Thompson | E04D 13/0409 4/290 |
| RE31,561 | E * | 4/1984 | Thompson | E04D 13/0409 4/290 |

(Continued)

FOREIGN PATENT DOCUMENTS

| | | | | |
|---|---|---|---|---|
| DE | 19622021 A1 * | 12/1997 | | E03F 5/06 |
| EP | 1630309 A1 | 3/2006 | | |

(Continued)

*Primary Examiner* — Brent W Herring

(74) *Attorney, Agent, or Firm* — Husch Blackwell LLP

(57) ABSTRACT

An elevator trench drain including a trench at least partially defining a drain volume, where the trench includes a base wall and at least one side wall extending from the base wall, a conduit coupled to the trench and open to the drain volume, and a grate coupled to the trench. The grate includes a top surface defining a periphery, at least one wall extending from a periphery of the top surface and configured to contact the base wall of the trench, and a support configured to selectively contact the base wall at a location inside the periphery of the top surface.

25 Claims, 32 Drawing Sheets

(56) References Cited

U.S. PATENT DOCUMENTS

| | | | | |
|---|---|---|---|---|
| 4,541,132 | A | 9/1985 | Long | |
| 4,912,349 | A | 3/1990 | Chang | |
| 4,964,180 | A | 10/1990 | Harbeke | |
| 5,017,039 | A | 5/1991 | Spiess et al. | |
| 5,195,292 | A * | 3/1993 | Bedies | E04F 19/10 52/177 |
| 5,213,438 | A | 5/1993 | Barenwald | |
| 5,319,812 | A | 6/1994 | Harrahan et al. | |
| 5,324,135 | A | 6/1994 | Smith | |
| D355,707 | S | 2/1995 | Emanuele et al. | |
| 5,466,091 | A | 11/1995 | Sauerwin et al. | |
| 5,864,990 | A | 2/1999 | Tu | |
| 5,954,952 | A | 9/1999 | Strawse, Sr. | |
| 5,979,607 | A | 11/1999 | Allen | |
| 6,003,169 | A | 12/1999 | Davis, Jr. | |
| 6,272,804 | B1 | 8/2001 | Leis | |
| 6,290,143 | B1 | 9/2001 | Vincent et al. | |
| 6,558,769 | B1 | 5/2003 | Chwala | |
| 6,810,537 | B1 | 11/2004 | Barnes et al. | |
| 6,941,703 | B2 | 9/2005 | MacLean et al. | |
| 7,033,489 | B2 | 4/2006 | Thompson et al. | |
| D523,537 | S | 6/2006 | Howard | |
| 7,114,872 | B2 | 10/2006 | Alba | |
| 7,293,937 | B2 | 11/2007 | Fuchs | |
| 7,303,669 | B2 | 12/2007 | Monneret | |
| 7,316,834 | B2 | 1/2008 | Hernandez | |
| D582,527 | S | 12/2008 | Wang | |
| 7,588,392 | B2 | 9/2009 | Wroblewski et al. | |
| 7,631,471 | B2 | 12/2009 | Grunewald et al. | |
| 7,744,304 | B2 | 6/2010 | Akkala et al. | |
| 8,181,288 | B1 | 5/2012 | Davis, Jr. | |
| 8,226,824 | B2 | 7/2012 | Mondschein et al. | |
| D672,015 | S | 12/2012 | Luke | |
| 8,474,068 | B2 | 7/2013 | Kik, Sr. et al. | |
| 8,505,125 | B1 | 8/2013 | Chia et al. | |
| 8,549,678 | B2 | 10/2013 | Neidich et al. | |
| 8,658,033 | B2 | 2/2014 | Farkas | |
| 8,677,521 | B2 | 3/2014 | Stimpson | |
| 8,800,226 | B2 | 8/2014 | Bloch | |
| 9,010,363 | B2 | 4/2015 | Huber | |
| 9,027,715 | B2 | 5/2015 | Bloch et al. | |
| 9,206,593 | B2 | 12/2015 | Tripodi et al. | |
| 9,382,701 | B2 | 7/2016 | Meyers | |
| 9,617,723 | B2 | 4/2017 | Stonecipher et al. | |
| 9,777,489 | B2 | 10/2017 | Gomo et al. | |
| 10,047,512 | B2 | 8/2018 | Chromey | |
| 10,240,351 | B2 | 3/2019 | Gomo et al. | |
| 10,501,926 | B2 | 12/2019 | Prieter | |
| 10,570,628 | B2 | 2/2020 | Gomo et al. | |
| 10,975,583 | B2 | 4/2021 | Gomo et al. | |
| 11,131,069 | B2 * | 9/2021 | Priester | E01F 5/00 |
| 2002/0078498 | A1 | 6/2002 | Cheng | |
| 2004/0238424 | A1 | 12/2004 | Thompson et al. | |
| 2004/0256298 | A1 | 12/2004 | Curlol | |
| 2005/0230295 | A1 | 10/2005 | Monneret | |
| 2005/0284704 | A1 | 12/2005 | Hernandez, Jr. | |
| 2006/0171778 | A1 | 8/2006 | Fuchs | |
| 2006/0239773 | A1 * | 10/2006 | Meyers | E03F 3/046 404/2 |
| 2007/0034577 | A1 | 2/2007 | Bayard et al. | |
| 2008/0014022 | A1 | 1/2008 | Wroblewski et al. | |
| 2008/0276368 | A1 | 11/2008 | Neidich et al. | |
| 2009/0097921 | A1 | 4/2009 | Hetzler et al. | |
| 2009/0113621 | A1 | 5/2009 | DeGooyer et al. | |
| 2009/0236293 | A1 | 9/2009 | Alvarado | |
| 2010/0162481 | A1 | 7/2010 | Erlebach | |
| 2010/0319281 | A1 * | 12/2010 | Egan | E03F 5/0407 52/302.1 |
| 2011/0023978 | A1 | 2/2011 | Keizers | |
| 2011/0067175 | A1 | 3/2011 | Sleylaerts et al. | |
| 2011/0088161 | A1 | 4/2011 | Stimpson | |
| 2011/0139694 | A1 | 6/2011 | Mondschein et al. | |
| 2011/0162137 | A1 | 7/2011 | Kik, Sr. et al. | |
| 2011/0185657 | A1 | 8/2011 | Delaquis | |
| 2012/0031712 | A1 | 2/2012 | Bloch et al. | |
| 2012/0110827 | A1 | 5/2012 | Doolittle et al. | |
| 2012/0266968 | A1 | 10/2012 | Bloch et al. | |
| 2012/0273050 | A1 * | 11/2012 | Metzger | E03F 5/0411 137/67 |
| 2012/0324644 | A2 | 12/2012 | Neidich et al. | |
| 2013/0098472 | A1 | 4/2013 | Farkas | |
| 2013/0276226 | A1 | 10/2013 | Cook et al. | |
| 2013/0326806 | A1 | 10/2013 | Stonecipher et al. | |
| 2014/0230140 | A1 | 8/2014 | Davis, Jr. | |
| 2014/0262996 | A1 | 9/2014 | Alvarado | |
| 2014/0352815 | A1 | 12/2014 | Brodey et al. | |
| 2014/0373943 | A1 | 12/2014 | Huber | |
| 2015/0240464 | A1 | 8/2015 | Meyers | |
| 2015/0275498 | A1 | 10/2015 | Belanger | |
| 2015/0306092 | A1 | 10/2015 | Chromey et al. | |
| 2016/0194861 | A1 | 7/2016 | Nivelles | |
| 2016/0305109 | A1 | 10/2016 | Meyers | |
| 2016/0309965 | A1 | 10/2016 | Berkey | |
| 2017/0089331 | A1 | 3/2017 | Bialick et al. | |
| 2017/0211267 | A1 | 7/2017 | Stonecipher et al. | |
| 2017/0241145 | A1 * | 8/2017 | Gomo | E03F 5/06 |
| 2018/0030713 | A1 | 2/2018 | Howson | |
| 2018/0087260 | A1 | 3/2018 | Priester | |
| 2018/0320357 | A1 | 11/2018 | Chromey et al. | |
| 2018/0320358 | A1 | 11/2018 | Chromey et al. | |
| 2019/0032323 | A1 | 1/2019 | Priester | |
| 2021/0102348 | A1 * | 4/2021 | Priester | E03F 3/046 |

FOREIGN PATENT DOCUMENTS

| | | | | |
|---|---|---|---|---|
| EP | 2902556 | A1 * | 8/2015 | E03F 5/06 |
| GB | 2468838 | A | 9/2010 | |
| JP | S52115038 | A | 9/1977 | |
| JP | H05105350 | A | 4/1993 | |
| JP | H06227773 | A | 8/1994 | |
| JP | H0761743 | A | 3/1995 | |
| JP | H1059661 | A | 3/1998 | |
| JP | H10324485 | A | 12/1998 | |
| JP | 2000219453 | A | 8/2000 | |
| JP | 2005082363 | A | 3/2005 | |
| JP | 2009196729 | A | 9/2009 | |
| JP | 2011195249 | A | 10/2011 | |
| JP | 2016156245 | A | 9/2016 | |
| WO | WO9822381 | A1 | 5/1998 | |
| WO | WO2014012526 | A1 | 1/2014 | |

* cited by examiner

ELEVATOR TRENCH DRAIN

CROSS-REFERENCE TO RELATED APPLICATIONS

This application claims priority to U.S. Provisional Patent Application No. 63/145,802 filed on Feb. 4, 2021, the contents of which are hereby incorporated by reference.

FIELD OF THE INVENTION

The present disclosure relates to a trench drain and more specifically a trench drain for use at the threshold of an elevator.

BACKGROUND

Regulations increasingly require the presence of an elevator trench drain at the threshold of an elevator door opening to collect and dispense of water present on the corresponding floor to avoid having water enter into the elevator shaft itself.

SUMMARY

In some embodiments, an elevator trench drain including a trench at least partially defining a drain volume, where the trench includes a base wall and at least one side wall extending from the base wall, a conduit coupled to the trench and open to the drain volume, and a grate coupled to the trench. The grate includes a top surface defining a periphery, at least one wall extending from a periphery of the top surface and configured to contact the base wall of the trench, and a support configured to selectively contact the base wall at a location inside the periphery of the top surface.

In other embodiments, an elevator trench drain including a trench having a base wall, where the trench at least partially defines a drain volume therein, a conduit open to the drain volume, a grate including a top surface having a periphery and defining at least one aperture therethrough, a first wall extending from the periphery of the top surface and configured to contact the base wall, a second wall extending from the periphery of the top surface opposite the first wall and configured to contact the base wall, and a support configured to contact the base wall at a location between the first wall and the second wall.

In other embodiments, an elevator trench drain including a trench at least partially defining a drain volume, a grate including a top surface defining at least one aperture therein, and a conduit open to the drain volume, where the conduit includes an interior surface at least partially defining a channel with a channel axis extending therethrough, where the channel defines a cross-sectional area taken normal to the channel axis, and wherein the cross-sectional area smoothly and continuously reduces from the inlet to the outlet.

Other aspects of the disclosure will become apparent by consideration of the detailed description and accompanying drawings.

DETAILED DESCRIPTION

Figure 1:
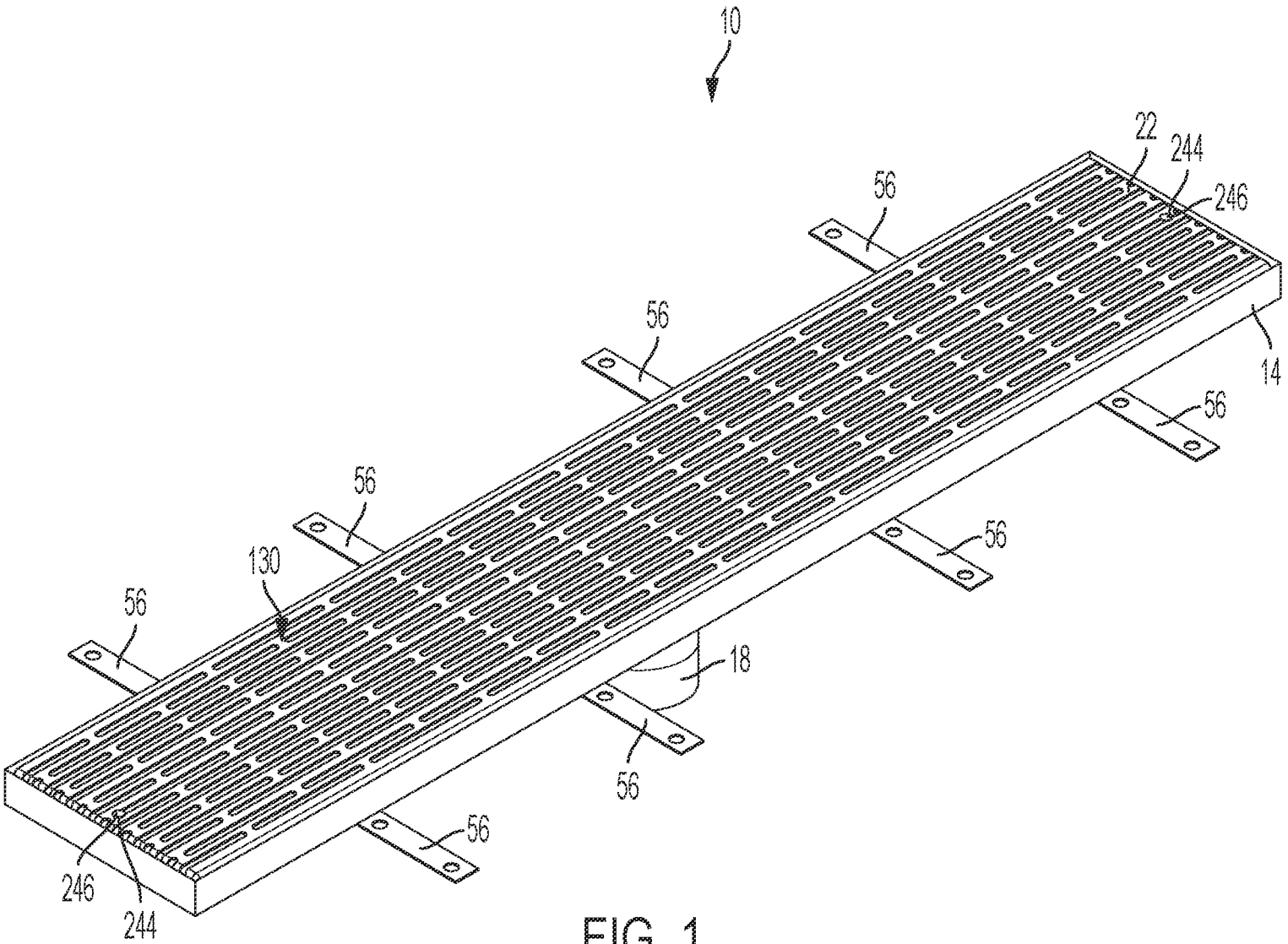
FIG. 1 is a perspective view of an embodiment of a trench drain.
Figure 2:
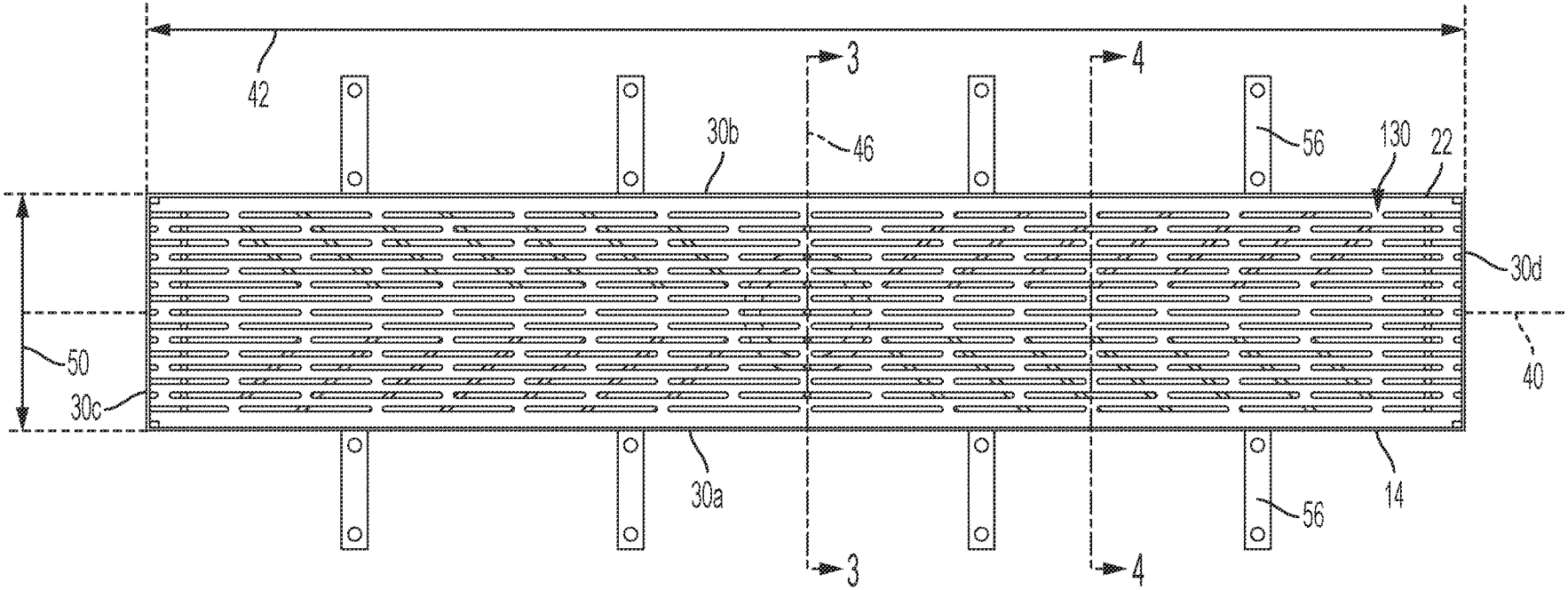
FIG. 2 is a top view of the trench drain of FIG. 1.

Before any embodiments of the disclosure are explained in detail, it is to be understood that the disclosure is not limited in its application to the details of the formation and arrangement of components set forth in the following description or illustrated in the accompanying drawings. The disclosure is capable of supporting other implementations and of being practiced or of being carried out in various ways.

FIGS. 1-4 illustrate a trench drain 10 for use proximate the threshold of an elevator door (not shown) to avoid having any water present on the floor from entering the corresponding elevator shaft. More specifically, the elevator trench drain 10 is often positioned proximate the threshold of the elevator door so that one side thereof is positioned adjacent and parallel to the threshold of the elevator doors. In such embodiments, water is typically introduced into the drain from the direction opposite the elevator threshold. When installed, the drain 10 is typically installed in the floor so that the top of the drain 10 is flush with the top of the floor (e.g., the immediately adjacent tile, carpet, linoleum, and the like). The floor, in turn, defines a floor thickness between approximately 1.5 and 2.5 inches. More specifically, the "floor thickness" generally includes all of the "post-tension layers" applied onto the top of the underlying tensioned concrete slab. Such layers may include, but are not limited to, a post-tension concrete pour, thinset layer, tile, and the like.

The trench drain 10 includes a trench 14 defining a drain volume 12, a conduit 18 open to the drain volume 12, and a grate 22 at least partially positioned within the drain volume 12 and providing a top surface or support surface 130.

As shown in FIGS. 5-8, the trench 14 of the trench drain 10 generally forms an upward facing vessel at least partially defining the drain volume 12 therein. The trench 14 includes a base or bottom wall 26, and one or more walls 30*a-d* extending upwardly from the periphery of the base wall 26 to produce a distal edge 34. Together, the distal edges 34 of the one or more walls 30*a-d* form an open end 38.

In the illustrated embodiment the base wall 36 of the trench 14 is substantially rectangular in shape such that the trench 14 includes a front wall 30*a*, a rear wall 30*b* opposite the front wall 30*a*, and a pair of side walls 30*c*, 30*d* each extending between the front wall 30*a* and the rear wall 30*b*. The trench 14 also includes a major axis 40 that is centrally positioned and extends parallel to the front wall 30*a*, and a minor axis 46 that is centrally positioned and extends parallel to the side walls 30*c, d* (see FIG. 5). The base wall 36 also defines a trench length 42 (e.g., taken parallel to the major axis 40), and a trench width 50 (e.g., taken parallel to the minor axis 46). When installed, the trench 14 is oriented so that the rear wall 30*b* is positioned adjacent to the threshold of the elevator opening so that the front wall 30*a* faces into the room.

In the illustrated embodiment, the trench width 50 is approximately 10.5 inches. In other embodiments, the trench width 50 is between approximately 9 inches and 12 inches. In still other embodiments, the trench width 50 is between approximately 10 inches and 11 inches. Furthermore, the illustrated trench length 42 is approximately 96 inches. However in alternative embodiments the base length 42 may come in different sizes, such as but not limited to, between 36" to 96". Generally speaking, the trench drain 10 may be offered in different trench lengths with the trench width remaining substantially constant.

The trench 14 also defines a trench height 54 generally defined as the vertical height between the base wall 26 and the distal edge 34 of the one or more walls 30*a-d*. In the illustrated embodiment, the trench height 54 is equal to or less than the corresponding floor thickness (described above). In other embodiments, the trench height 54 is equal to or less than 2 inches. In still other embodiments, the trench height 54 is between 1 and 2.5 inches. In still other embodiments, the trench height is between 1 and 2 inches. In still other embodiments, the trench height is between 1.5 and 2 inches. In still other embodiments, the trench height 54 is approximately 1.75 inches. In still other embodiments, the trench height 54 is between 1.842 and 1.967 inches. In still other embodiments, the trench height 54 is equal to or less than 1.75 inches.

While the illustrated embodiment is rectangular in shape, it is understood that in alternative embodiments different sizes or shapes of drain 10 may be present. For example, the drain 10 may be circular, polygonal, elliptical, and the like as needed to restrict the flow of water into the corresponding elevator shaft.

The trench 14 of the drain 10 also includes one or more mounting brackets 56 each extending outwardly therefrom and defining a respective mounting hole 58. Each mounting hole 58, in turn, is sized and positioned to allow a fastener (not shown) to pass therethrough to secure the trench 14 of the drain 10 to the corresponding floor 16.

Figure 7:
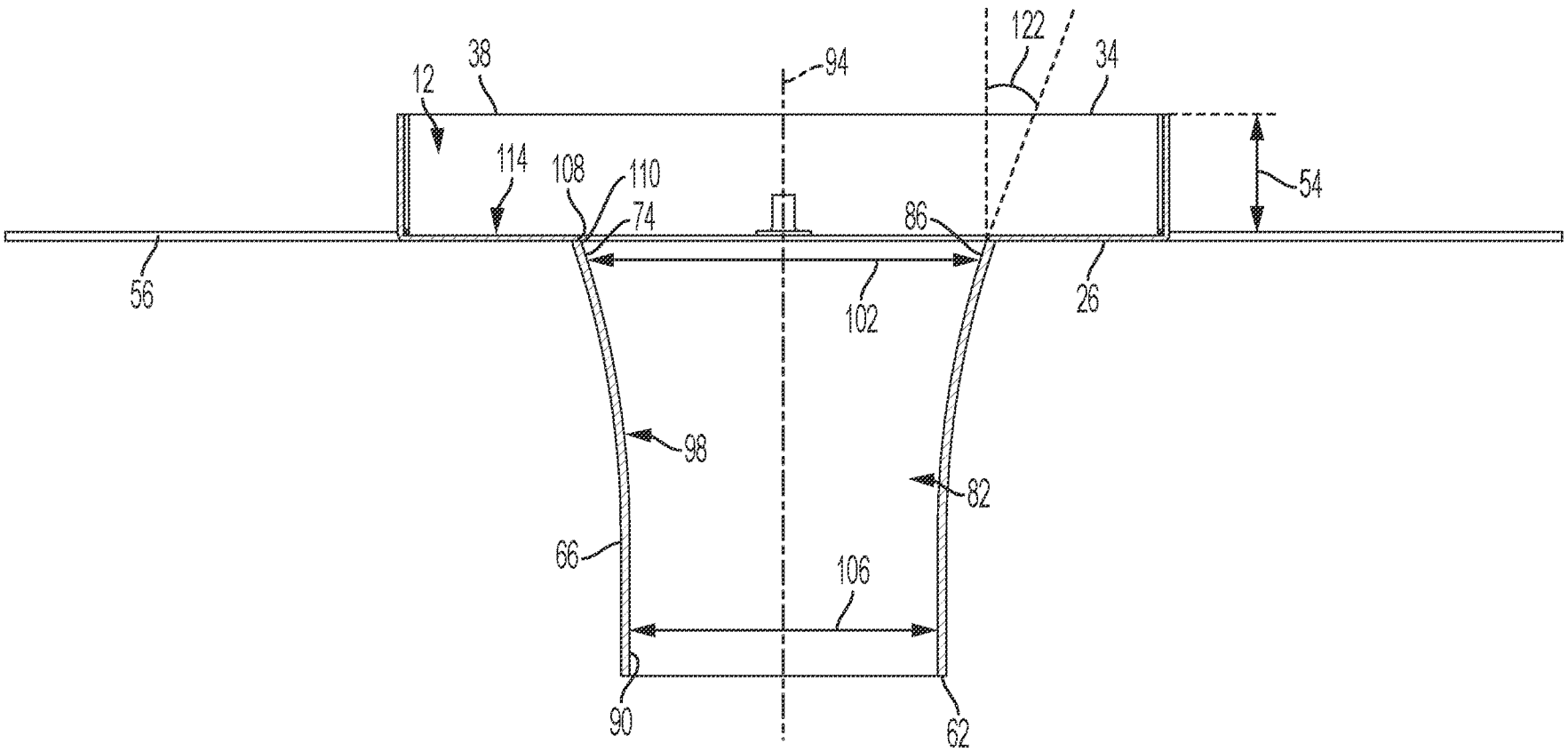
FIG. 7 is a section view taken along line 7-7 of FIG. 5.

The conduit 18 of the drain 10 defines a channel 82 with a channel axis 94 that is open to the drain volume 12 and extends therefrom to produce a distal end 62 (see FIG. 7). More specifically, the conduit 18 includes a toroidal outer wall 66 having a first end 74 coupled and open to the drain volume 12, and the distal end 62 opposite the first end 74 configured to be coupled to a drainage system (not shown). The outer wall 66 also at least partially defines the channel 82 such that the channel 82 has an inlet 86 proximate the first end 74 and an outlet 90 opposite the inlet 86 proximate the distal end 62. During use, water collected in the drain volume 12 flows into the inlet 86 of the channel 82, through the channel 82, and is discharged via the outlet 90 into the drainage system (not shown).

Figure 3:
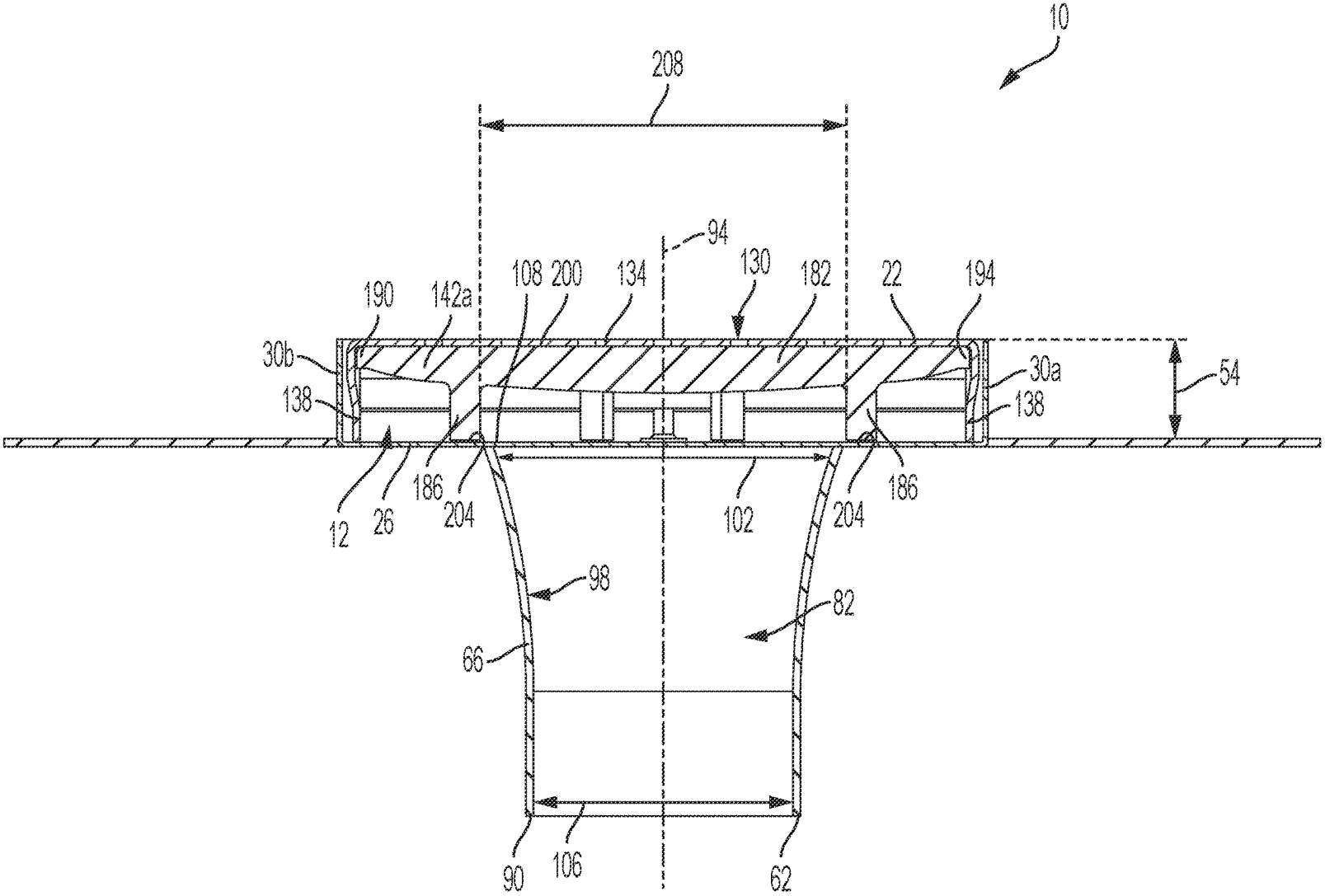
FIG. 3 is a section view taken along line 3-3 of FIG. 2.

As shown in FIG. 7, the outer wall 66 of the conduit 18 includes an inner surface 98 at least partially defining the channel 82. The channel 82, in turn, forms a channel cross-sectional shape taken normal to the channel axis 94. As shown in FIG. 3, the channel 82 is shaped such that the channel cross-sectional area continuously and smoothly reduces from the inlet 86 to the outlet 90. For the purposes of this application, the channel cross-sectional area is generally defined as the area of the cross-sectional shape taken normal to the channel axis 94 at a particular location.

The channel cross-sectional shape also defines a critical dimension 118. More specifically, the channel 82 is shaped such that the critical dimension 118 of the channel 82 smoothly and continuously reduces from the inlet 86 to the outlet 90. In the illustrated embodiment, the channel 82 is substantially circular in cross-sectional shape so that the critical dimension 118 is the channel diameter. In such an embodiment, the channel 82 is shaped such that the channel diameter smoothly and continuously reduces from the inlet 86 to the outlet 90. While the illustrated embodiment is circular, it is understood that the different sizes and shapes may be used (e.g., elliptical, polygonal, rectangular, and the like).

As shown in FIG. 7, the channel 82 defines an inlet diameter 102 (e.g., the cross-sectional diameter taken proximate the inlet 86) and an outlet diameter 106 (e.g., the cross-sectional diameter taken proximate the outlet 90). In the illustrated embodiment, the inlet diameter 102 is greater than the outlet diameter 106. More specifically, the inlet diameter 102 is approximately 6 inches and the outlet diameter 106 is approximately 4 inches. In some embodiments, the outlet 106 produces a 4 NH (4") No-Hub connection.

As shown in FIG. 3, the inner surface 98 of the outer wall 66 is convex in shape when taken as a cross-section along a plane parallel to the channel axis 94. More specifically, the inner surface 98 produces forms a radius when taken as a cross-section along a plane parallel to the channel axis 94 having a radius between 10 and 15 inches. In still other embodiments, the inner surface 98 produces a radius between 11 and 13 inches. In still other embodiments, the inner surface 98 produces a radius between 12 and 13 inches. In still other embodiments, the inner surface 98 produces a radius between 12 and 12.25 inches. In still other embodiments, the inner surface 98 produces a radius of approximately 12.1 inches.

Furthermore, the inner surface 98 is configured such that the inner surface 98 is substantially parallel to the channel axis 94 proximate the outlet 90 (e.g., the inner surface 98 forms a wall angle 122 of approximately 0 degrees) while the inner surface 98 is not parallel to the channel axis 94 proximate the inlet 86. In some embodiments, the inner surface 98 is flared outwardly at proximate the inlet 86. In still other embodiments, the inner surface 98 forms a wall angle 122 with respect to the channel axis 94 that is acute. In still other embodiments, the inner surface 98 forms a wall angle 122 that is greater than 0 degrees and less than 40 degrees. In still other embodiments, the wall angle 122 is between 10 degrees and 30 degrees. In still other embodiments, the wall angle 122 is approximately 20 degrees.

Figure 7A:
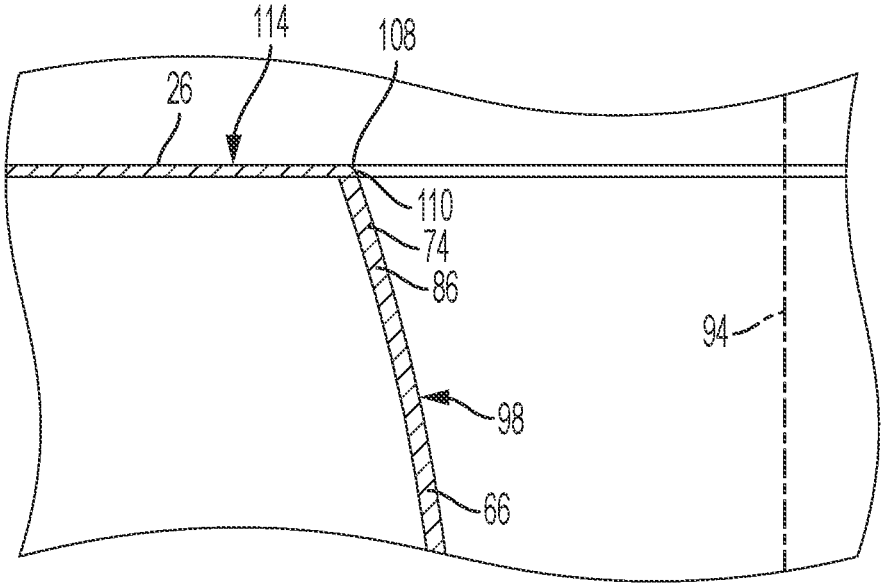
FIG. 7A is a detailed view taken from FIG. 7.
Figure 8:
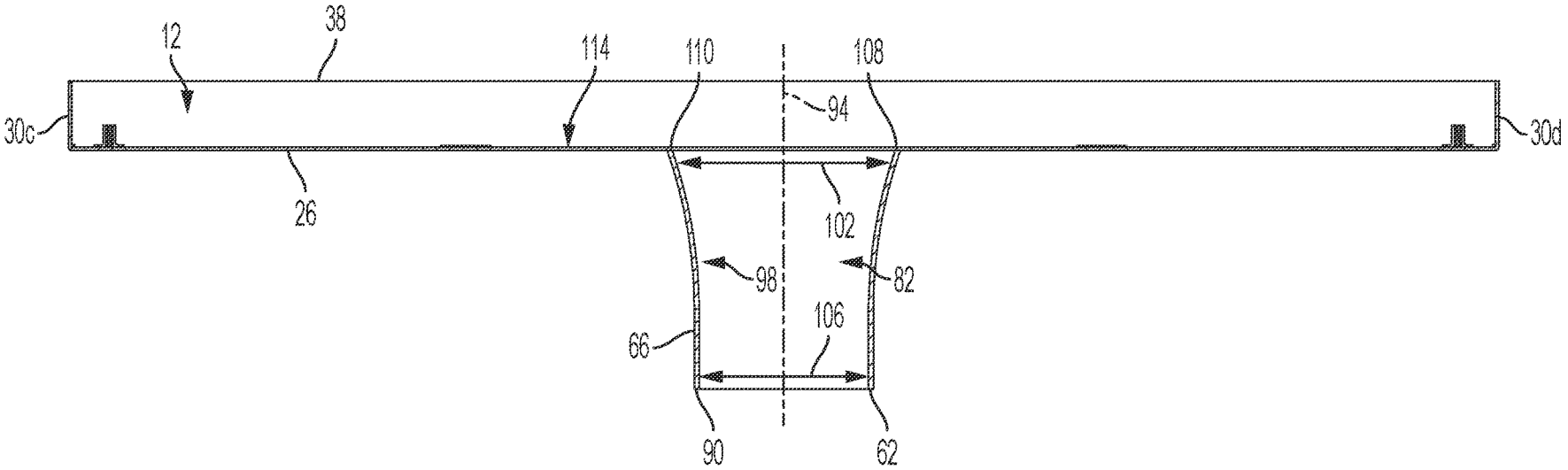
FIG. 8 is a section view taken along line 8-8 of FIG. 5.
Figure 9:
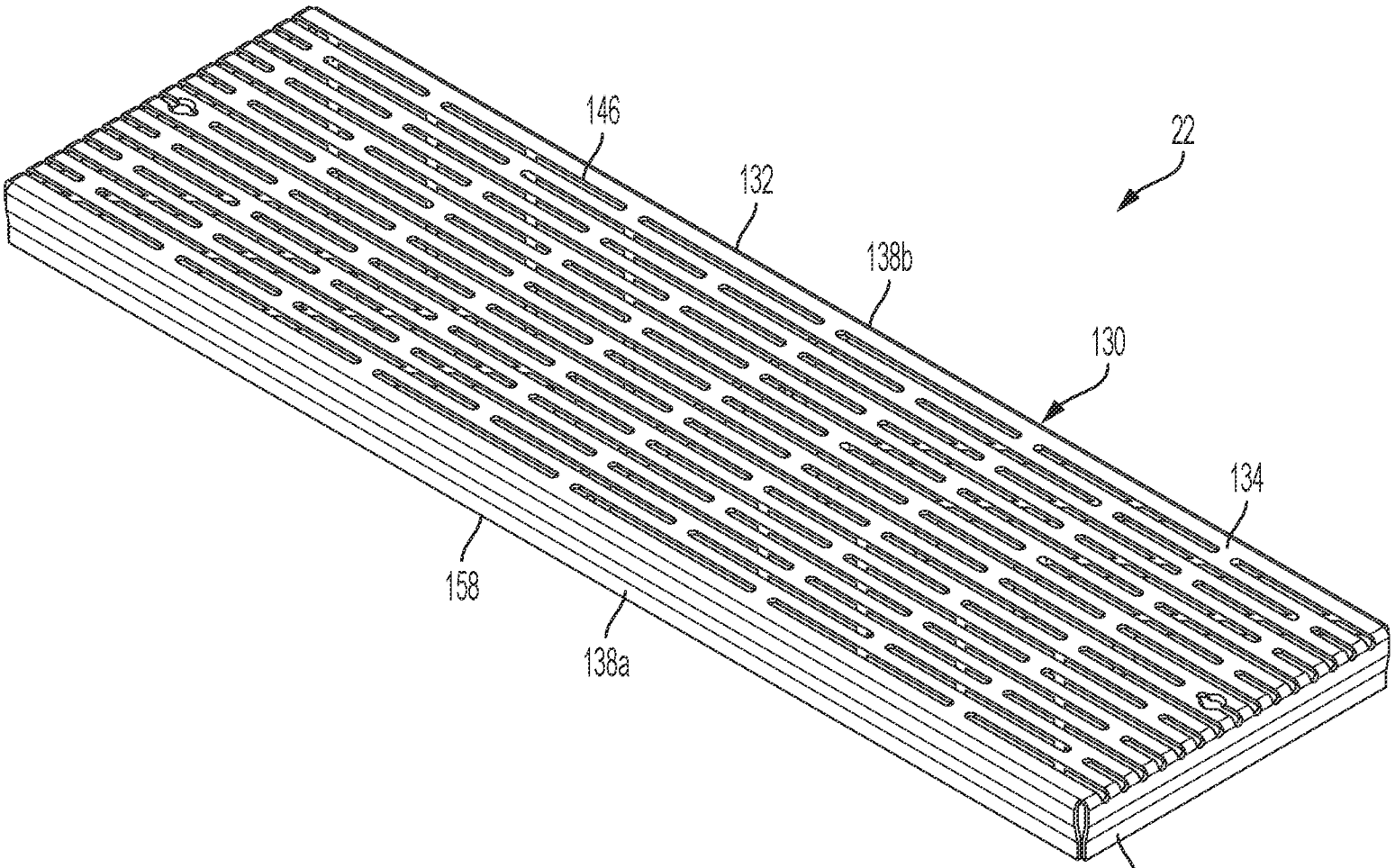
FIG. 9 is a perspective view of one embodiment of a grate of the trench drain of FIG. 1.

In the illustrated embodiment, the conduit 18 is mounted and open to an aperture 108 defined by the base wall 26 of the trench 14. More specifically, the first end 74 of the outer wall 66 is fused (e.g. welded, soldered, and the like) to the base wall 36 and the resulting joint ground to produce a radiused edge 110 (see FIG. 7A). The resulting edge 110 has an exterior surface that smoothly and continuously transitions between the top surface 114 of the base wall 36 and the inner surface 98 of the conduit 18. As shown in FIG. 3A, the edge 110 is convex and defines a radius of approximately 0.0625". In still other embodiments, the edge 110 radius is between 0.03125" and 0.125". In still other embodiments, the edge 110 radius is between approximately 0.0525" and 0.0725".

FIGS. 1-4 and 9-15 illustrate an embodiment of the grate 22 installable on the trench 14 and configured to enclose the open end 38 while also providing a support structure 134 with a support surface 130 upon which a user or users may stand and place items or other loads while still permitting water to flow therethrough into the drain volume 12. The grate 22 includes a support plate 134 at least partially defining the top surface 130 with a periphery 132. The grate 22 also includes a first perimeter wall 138*a* extending from the periphery 132 of the top surface 130, a second perimeter wall 138*b* extending from the periphery 132 of the top surface 130 opposite the first perimeter wall 138*a*, and one or more supports 142*a, b* configured to selectively transmit forces between the support structure 134 and the base wall 36 and positioned between the first perimeter wall 138*a* and the second perimeter wall 138*b* (e.g., within the periphery 132 of the top surface 130). During use, the perimeter walls 138*a, b* and supports 142*a, b* are configured to elevate and position the top surface 130 relative to the trench 14 while distributing any loads placed thereon into the floor 16 via the base wall 36.

Figure 6:
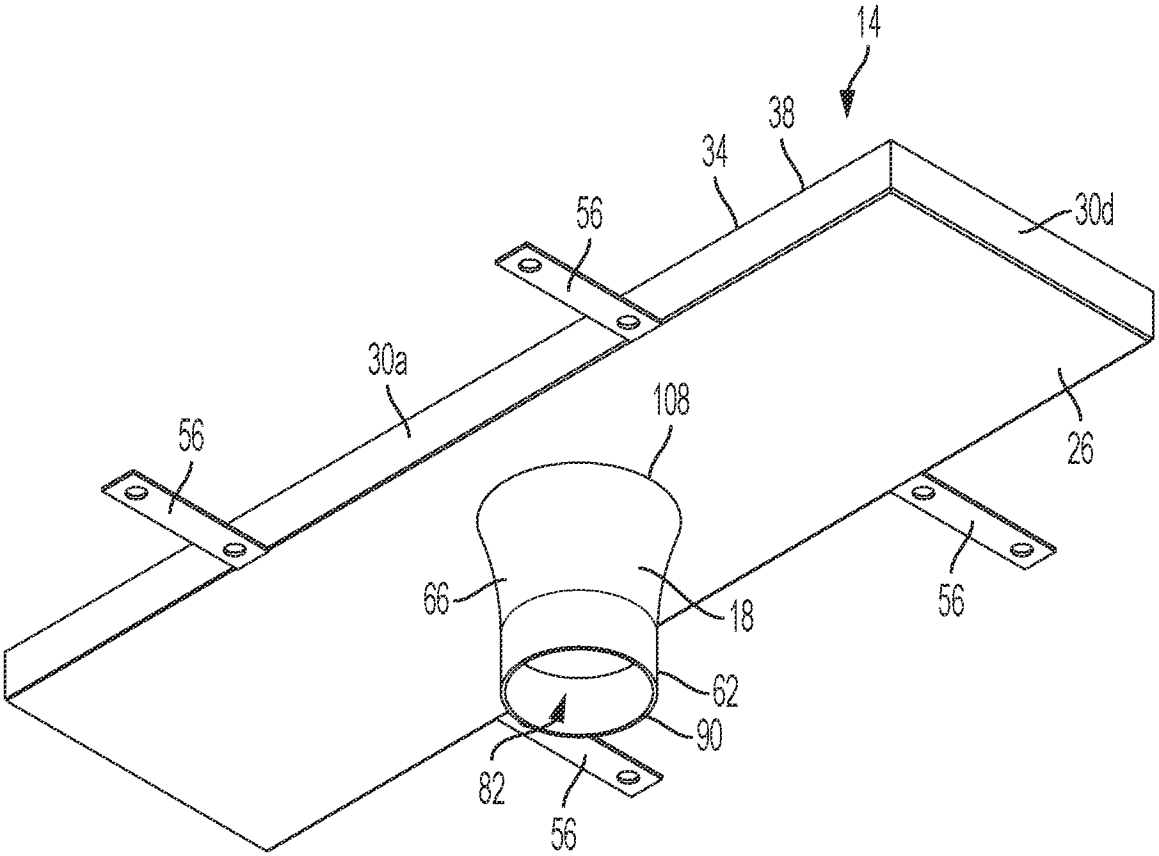
FIG. 6 is a bottom perspective view of the trench of FIG. 5.
Figure 10:
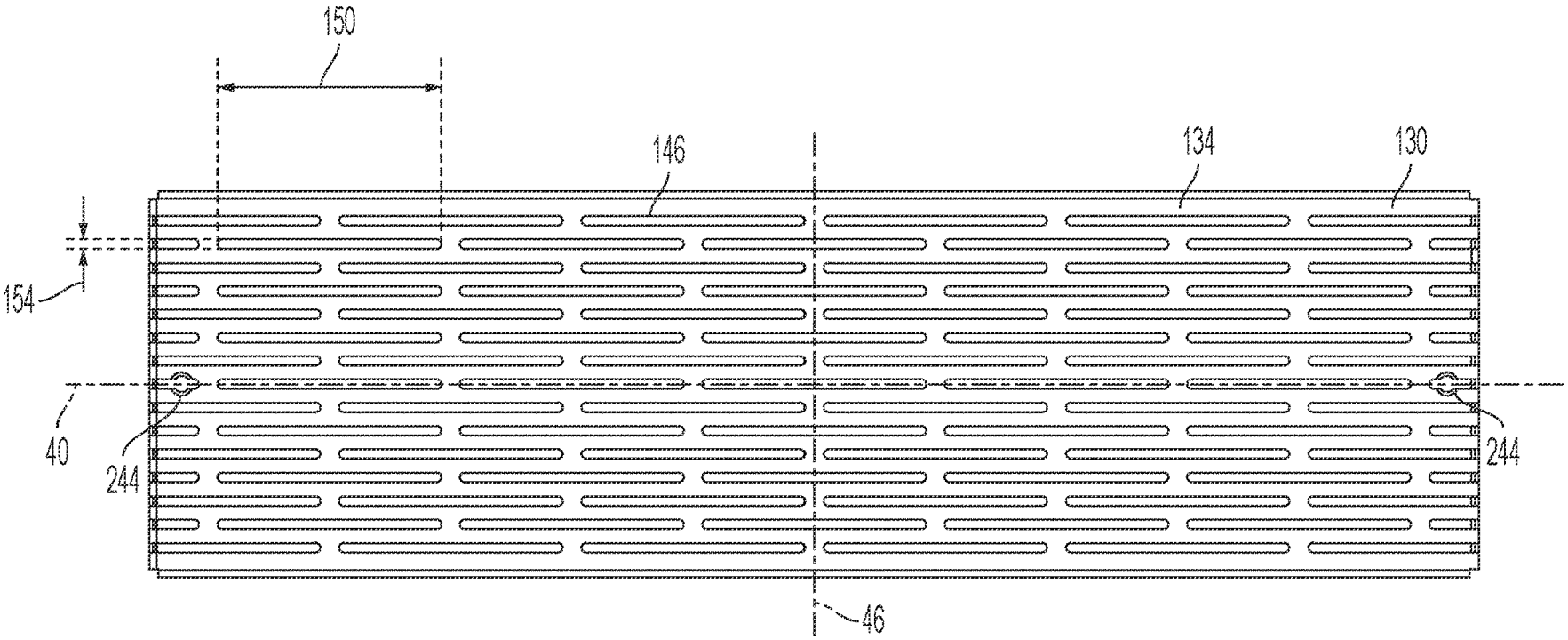
FIG. 10 is a top view of the grate of FIG. 9.

As shown in FIG. 10, the support plate 134 of the grate 22 defines a plurality of apertures 146 sized and shaped with sufficient open area to permit a predetermined volume of water to pass through the support plate 134 and into the drain volume 12 while minimizing the dimensions of the individual openings themselves so that various items (e.g., high heels, caster wheels, and the like) do not fall through or become stuck when passing over or stepping on the top surface 130 itself. In the illustrated embodiment, the support plate 134 defines a plurality of elongated apertures 146, each defining an aperture length 150 that is greater than an aperture width 154. As shown in FIG. 6, the aperture length 150 and width 154 are substantially aligned with the major and minor axes 40, 46 of the trench 14, respectively, with the aperture length 150 being approximately 5.75 inches and the aperture width 154 is approximately 0.25 inches.

As shown in FIG. 10, the elongated apertures 146 are positioned over the entire top surface 130 producing a rectangular array where each row is offset from adjacent rows by one-half of the length 150 of an aperture 146. While the illustrated embodiment shows each aperture 146 generally having similar dimensions and shapes, it is understood that in alternative embodiments one or more of the apertures 146 may have a size and/or shape that varies from the remaining apertures 146. It is also contemplated that the pattern in which the apertures 146 are arrange may also vary from that shown to accommodate flow and support requirements.

Figure 15:
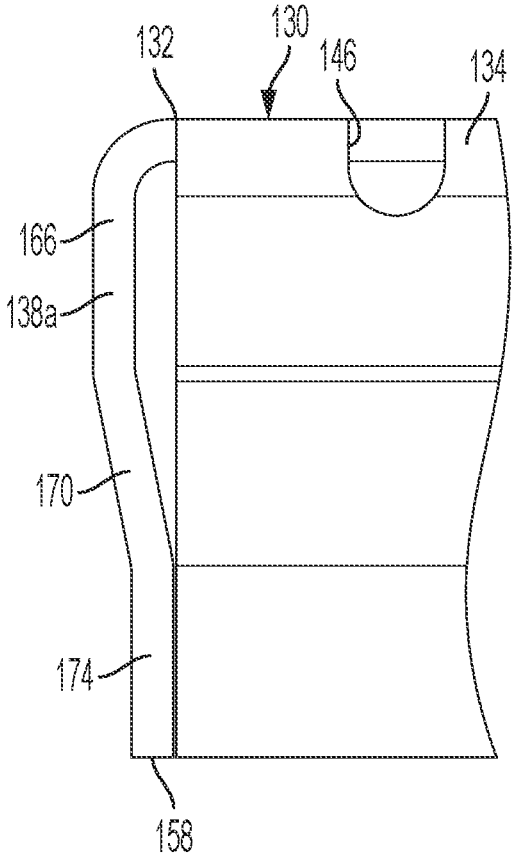
FIG. 15 is a detailed view of a perimeter wall of the grate of FIG. 9.

The perimeter walls 138*a, b* of the grate 22 extends downwardly from the periphery 132 of the support plate 134 to produce a distal end 158 (see FIG. 15). The distal end 158, in turn, is configured to engage with the base wall 26 to support and position the grate 22 relative to the trench 14. In the illustrated embodiment, the size and shape of the support plate 134 substantially corresponds with the size and shape of the open end 38 of the trench 14 so that, when installed, the perimeter walls 138*a-d* are positioned adjacent to and just inside of the corresponding walls 30*a-d* with the top surface 130 being substantially aligned with the distal edges 34 of the walls 30*a-d*. By doing so, the perimeter walls 138*a, b* support the grate 22 both vertically (e.g., by resting on the base wall 36) and laterally (e.g., by engaging the walls 30*a-d*).

As shown in FIG. 15, each perimeter wall 138*a-d* of the grate 22 has a "stepped" shape configured to offset the distal end 158 inwardly from the walls 30*a-d*. More specifically, each perimeter wall 138*a-d* has a first portion 166 extending downwardly from the periphery of the support plate 134, a transition portion 170 extending inwardly from the first portion 166, and a second portion 174 extending downwardly from the transition portion 170 to produce the distal end 158. The resulting structure offsets the distal end 158 of the perimeter wall 138 inwardly from its corresponding wall 30*a-d* of the trench 14. By doing so, the distal end 158 is able to avoid being located too close to the walls 30*a-d* which may cause the distal end 158 to interfere with any radiused edges forming between the base wall 26 and walls 30*a-d*. This allows the distal end to lay flat on the base wall 26 for more accurate location of the top surface 130 and better force transfer into the base wall 26. Furthermore, by offsetting the perimeter walls 138*a-d*, the first portion 166 remains close to the walls 30*a-d* to maximize lateral fit.

The grate 22 also includes one or more supports 142*a, b* that, when the grate 22 is installed in the trench 14, extend between the support plate 134 and the base wall 36 to transmit loads therebetween. More specifically, each supports 142*a, b* includes at least one "foot 186, 216" configured to contact the base wall 36 at an interior location of the support plate 134 (e.g., within the periphery thereof) and spaced a distance from the perimeter wall 138. Stated differently, support plate 134 and perimeter walls 138*a-d*, together enclose a support plate region 178 and the grate 22 includes at least one support 142*a, b* whose foot 186, 216 is configured to contact the base wall 36 at a location within the support plate region 178. In still other embodiments, the grate 22 includes at least one support 142*a, b*, whose foot is configured to contact the base wall 36 between the first perimeter wall 138*a* and the second perimeter wall 138*b*. In the illustrated embodiment, the grate 22 includes a center support 142*a* positioned proximate the conduit 18, and a plurality of lateral supports 142*b*.

Figure 12:
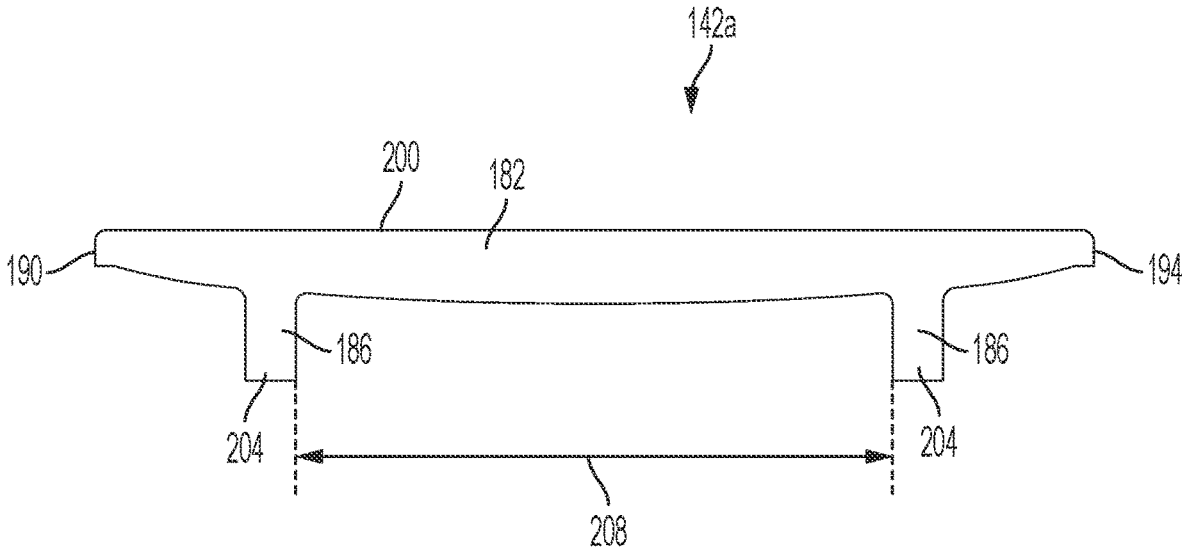
FIG. 12 is a detailed view of one embodiment of a support of the grate of FIG. 9.
Figure 13:
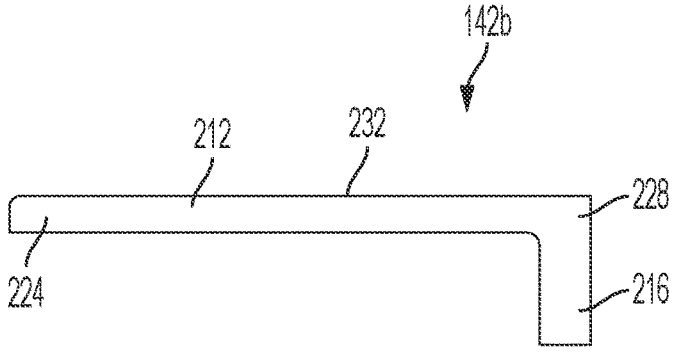
FIG. 13 is a detailed view is view of one embodiment of a support of the grate of FIG. 9.
Figure 14:
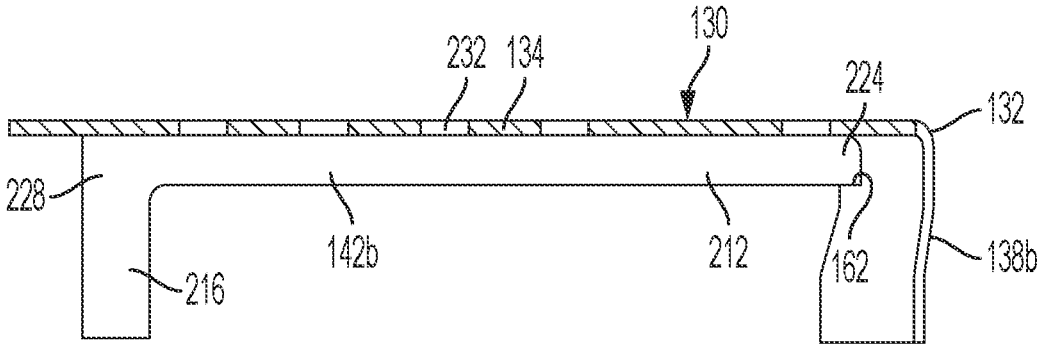
FIG. 14 is a detailed view of the support of FIG. 13 installed on the grate of FIG. 9.

As shown in FIGS. 3 and 12, the center support 142*a* includes a cross-member 182 and a plurality (e.g., two) of feet 186 extending downwardly from the cross member 182 and configured to contact the base wall 36 when the grate 22 is installed within the drain volume 12. The cross-member 182 of the center support 142*a* extends substantially the width of the trench 14 (e.g., the trench width 50) having a first end 190 proximate the first perimeter wall 138*a*, and a second end 194 opposite the first end 190 that is proximate the second perimeter wall 138*b*. The cross-member 182 also includes a top edge 200 configured to engage and support the support plate 134. By doing so, forces applied to the support plate 134 proximate the center support 142*a* are directed into the center support 142*a* where the forces are directed into the base wall 36 via the two feet 186 (described below) and via both perimeter walls 138*a, b*. In the illustrated embodiment, the center support 142*a* is welded or otherwise coupled to the grate 22. In still other embodiments, the center support 142*a* may be internally formed with the grate 22.

The feet 186 of the center support 142*a* extend downwardly from the cross-member 182 to produce a distal end 204 that, when the grate 22 is installed, is in contact with the base wall 36 of the trench 14. In the illustrated embodiment, the center support 142*a* is positioned such that it extends across the opening of the inlet 86 of the conduit 18 (e.g., parallel and aligned with the minor axis 46) with each foot 186 positioned just radially outside thereof. More specifically, the two feet 186 of the center support 142*a* define a gap 208 therebetween that is equal to or larger than the inlet diameter 102 of the conduit 18.

Each lateral support 142*b* of the grate 22 is substantially "L" shaped having a cross-member 212 and a foot 216 extending from one end of the cross-member 212 to produce a distal end 220 configured to engage the base wall 36. More specifically, the cross-member 212 of each lateral support 142*b* includes a first end 224 positioned proximate to a corresponding perimeter wall 138*a-d*, and a second end 228 opposite the first end 224 from which a corresponding foot 216 extends. Each cross-member 212 also includes a top edge 232 configured to engage and support the support plate 134. By doing so, forces applied to the support plate 134 proximate a corresponding lateral support 142*b* are transferred into the lateral support 142*b* where the forces are then directed into the base wall 36 via the foot 216 (described below) and via the adjacent perimeter wall 138. In the illustrated embodiment, each lateral support 142*b* is welded or otherwise coupled to the grate 22. In still other embodiments, the lateral supports 142*b* may be formed integrally with the grate 22.

Figure 11:
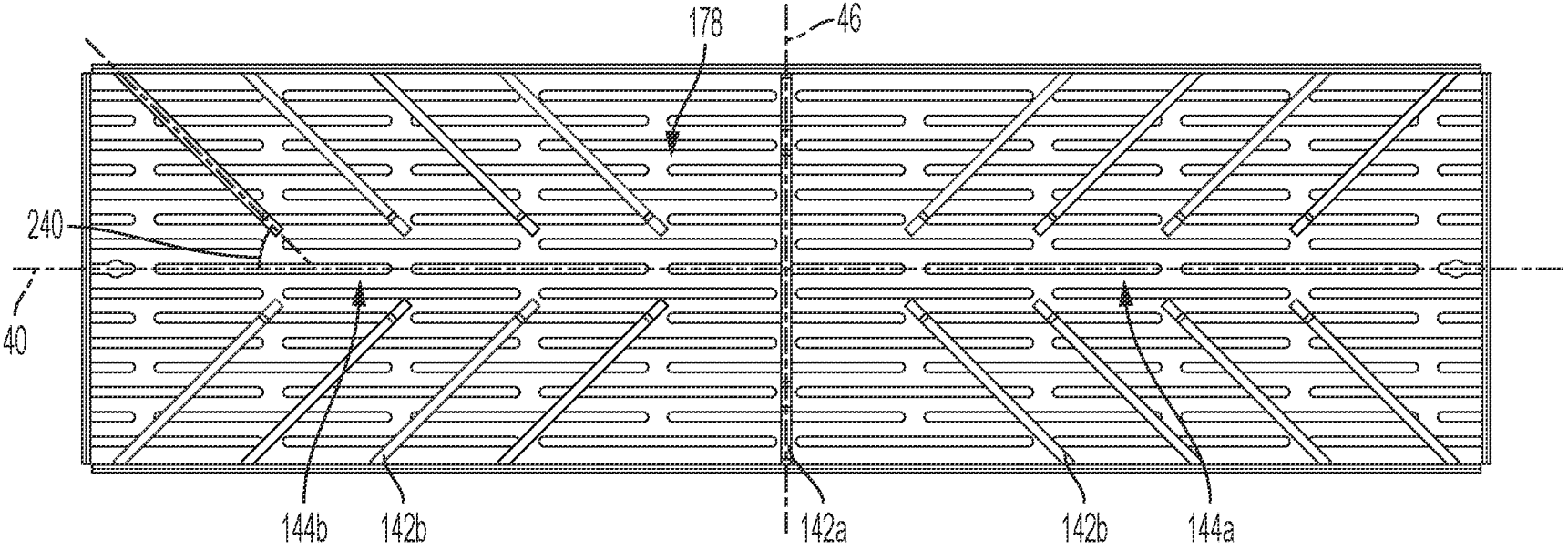
FIG. 11 is a bottom view of the grate of FIG. 9.

As shown in FIG. 11, the lateral supports 142*b* of the illustrated grate 22 are oriented in two chevron patterns, each oriented along one half of the major axis 40. More specifically, each lateral support 142*b* defines a longitudinal axis 236 therethrough that, in turn, defines a rake angle 240 with respect to the major axis 40. For the purposes of this application, the rake angle 240 is defined as the angle between the longitudinal axis 236 of the corresponding lateral support 142*b* and the major axis 40 of the trench 14 taken opposite the conduit 18 (e.g., on the outside of the angle). In the illustrated embodiment, the rake angle 240 is less than 90 degrees. In still other embodiments, the rake angle 240 is approximately 45 degrees. In still other embodiments, the rake angle 240 is between 30 and 60 degrees. While the illustrated supports 142*b* are oriented such that each lateral support 142*b* has the same rake angle 240, it is understood that in alternative embodiments the rake angle 240 may vary between different supports 142*b*.

Figure 4:
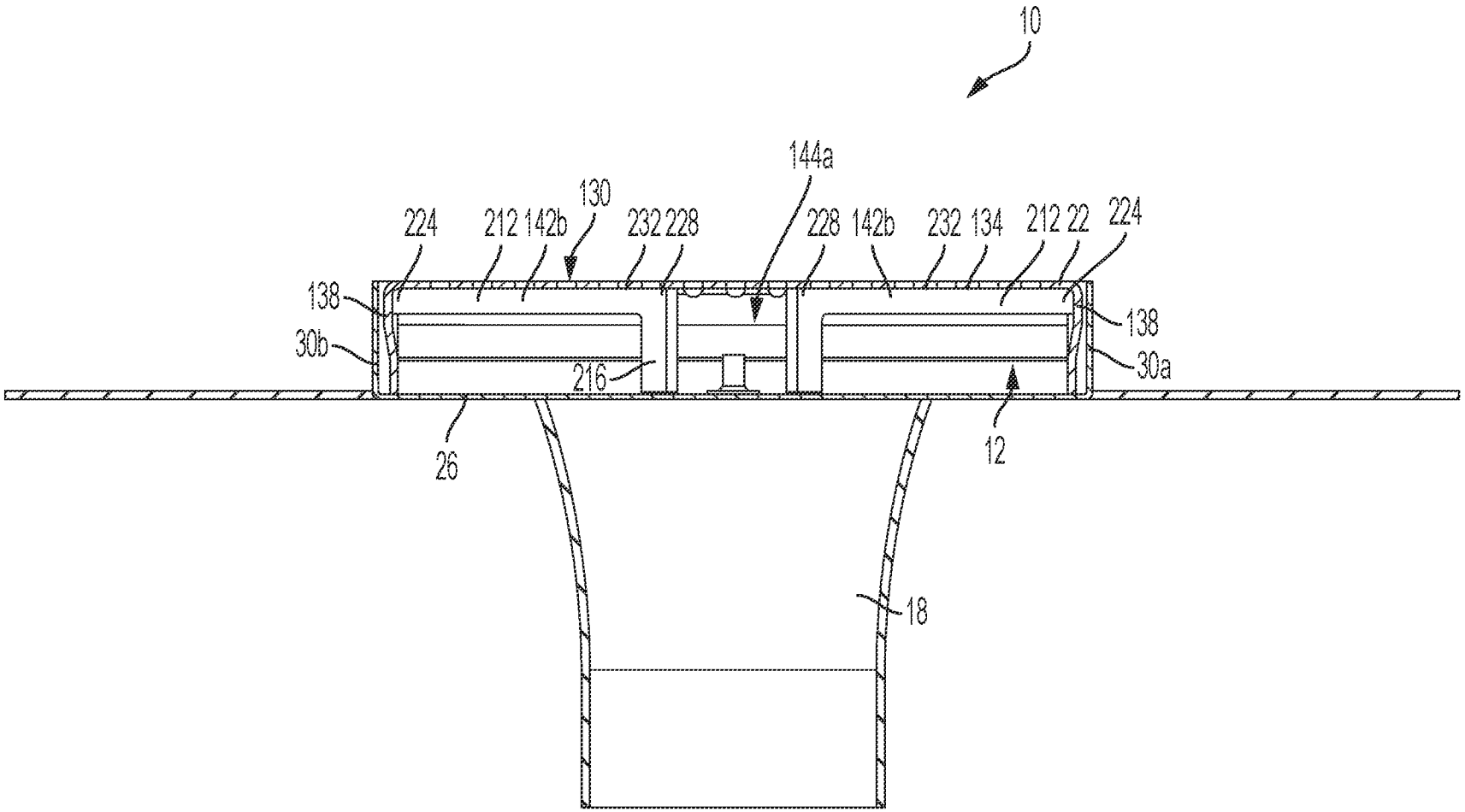
FIG. 4 is a section view taken along line 4-4 of FIG. 2.
Figure 5:
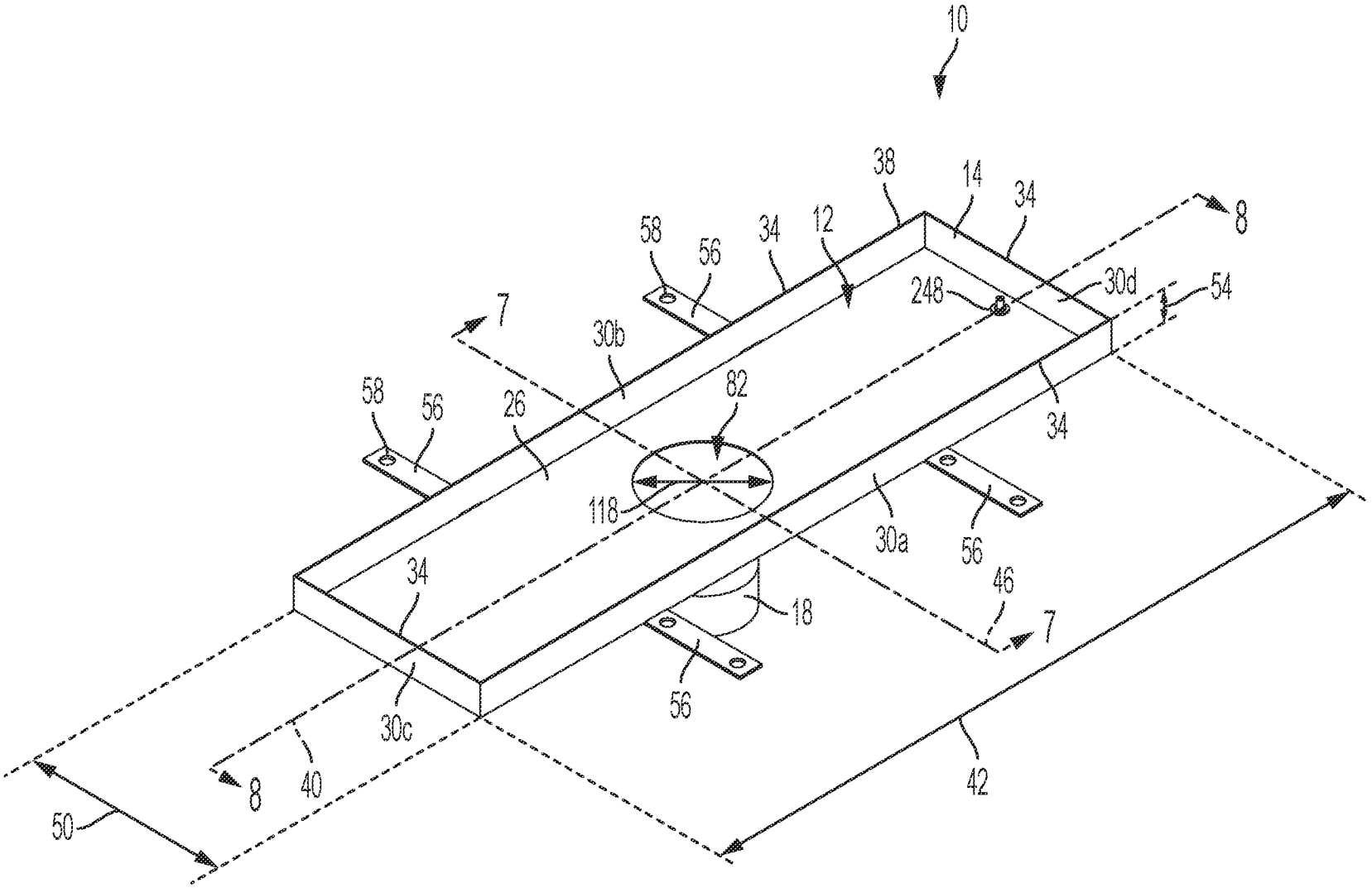
FIG. 5 is a perspective view of a trench of the trench drain of FIG. 1.

Continuing with FIG. 4, the lateral supports 142*b* are also positioned so that the second end 228 of the supports 142*b* are spaced a distance from the major axis 40 (and a distance from the support 142*b* positioned opposite it relative to the major axis 40) to form a pair of flow channels 144*a, b* therebetween. Each flow channel 144*a, b*, in turn, extends from the inlet 86 of the conduit 18 to a respective end portion of the perimeter wall 138—being separated from each other by the center support 142*a*. More specifically, each flow channel 144*a, b* includes a region open to the inlet 86 of the conduit 18 where the drain volume 12 is completely unobstructed vertically from the base wall 26 to the support structure 134.

In some embodiments, the feet 186, 216 may be positioned slightly above the base wall 26 when no load is being applied to the grate 22. In such embodiments, the grate 22 is configured to flex under load so that the feet 186, 216 engage the base wall 26 to provide support to the support structure 134. Spacing the feet 186, 216 from the base wall 26 helps eliminate squeaking noises and allows the top surface 130 to remain flatter during use.

As shown in FIG. 1, the grate 22 may also include one or more mounting apertures 244 configured to receive a fastener 246 therethrough. More specifically, each mounting aperture 244 is aligned with a corresponding mounting boss 248 (see FIG. 5) coupled to the trench 14 such that a fastener 246 inserted into the aperture 244 may be threadably coupled to the boss 248 to secure the grate 22 to the trench 14.

To manufacture and install the drain 10, the user first prepares the trench 14, the conduit 18, and the grate 22. With the three components prepared, the user then welds the first end 74 of the conduit 18 to the base wall 36 of the trench 14. More specifically, the conduit 18 is welded to the base wall 36 from the inside producing an internal bead of weld material. Once welded, the user then shapes, machines, and/or forms the bead of weld material to produce the final radiused edge 110 (described above). More specifically, the weld material may be worked so that the resulting structure has the visual appearance of a single piece of material with the top surface 114 of the base wall 36 being continuous with the inner surface 98 of the conduit 18.

With the conduit 18 attached. The user can then install the resulting trench 14 and conduit 18 combination into the floor of a building or the like. To do so, the user first places the base wall 36 against the sub-floor and positions the trench 14 so that the rear wall 30*b* is positioned adjacent to the threshold of the corresponding elevator door. With the drain 10 in position, the user can then secure the trench 14 to the subfloor by inserting fasteners through the mounting holes 58 of the mounting brackets 56. With the trench 14 in place, the user can then connect the distal end 78 of the conduit 18 to the building drainage system.

Finally, the user can insert the grate 22 into the trench 14 so that the distal end 158 of the perimeter wall 138 and the feet 186, 216 of the supports 142*a, b* are in contact with the base wall 36. The user may then secure the grate 22 to the trench 14 using one or more fasteners (described above).

During use, water collecting on the floor proximate to where the drain 10 is installed is directed into the drain 10 for proper drainage. More specifically, water or other fluids collecting on the floor will flow over the distal end 158 of the walls 30*a-d*(e.g., the open end 38), through the apertures 146 of the support plate 134, and into the drain volume 12. Once inside the drain volume 12, the fluid flows toward and into the inlet 86 of the conduit 18 where it is directed into the drainage system. More specifically, as the fluid flows within the drain volume 12, the chevron layout of the supports 142*a, b* help direct the fluid toward the corresponding flow channels 144*a, b* where the fluid can flow unobstructed toward the inlet 86 of the conduit 18. By doing so, the supports 142*a, b* are able to provide maximum support to the support plate 134 while still allowing the drain 10 to flow the maximum volume of water possible (e.g., does not incur excessive resistance to the water flow within the volume 12).

The trench drain 10 utilizing the above described grate 22 is able to flow approximately 110 gallons per minute (GPM). In other embodiments, the drain 10 with grate 22 is able to flow between 108 GPM and 112 GPM. In still other embodiments, the drain 10 with grate 22 is able to flow between 108.1 GPM and 111.8 GPM. In still other embodiments, the drain 10 with grate 22 is able to flow approximately 109.9 GPM. The above described values may vary by approximately 1-2%.

In still other embodiments, the drain 10 with grate 22 is able to flow approximately 110 GPM when the water is introduced into the drain 10 over a single wall (e.g., front wall 30*a*) and with a trench length 42 of 96 inches. For the purposes of this application, water being "introduced over a single wall" means that the water entering the drain 10 is only doing so by flowing over the distal edge 34 of only one of the four walls 30*a-d* of the drain 10 (e.g., the front wall 30*a*). As such, no water is being introduced over the distal edge 34 of the three remaining walls (e.g., the rear wall 30*b*, and two side walls 30*c, d*). In some embodiments, the drain 10 with grate 22 is able to flow between 108 GPM and 112 GPM with water being introduce only over the front wall 30*a*. In still other embodiments, the drain 10 with grate 22 is able to flow between 108.1 GPM and 111.8 GPM with water being introduced only over the front wall 30*a*. In still other embodiments, the drain 10 with grate 22 is able to flow approximately 109.9 GPM with water being introduced only over the front wall 30*a*. The above described values may vary by approximately 1-2%.

Figure 16:
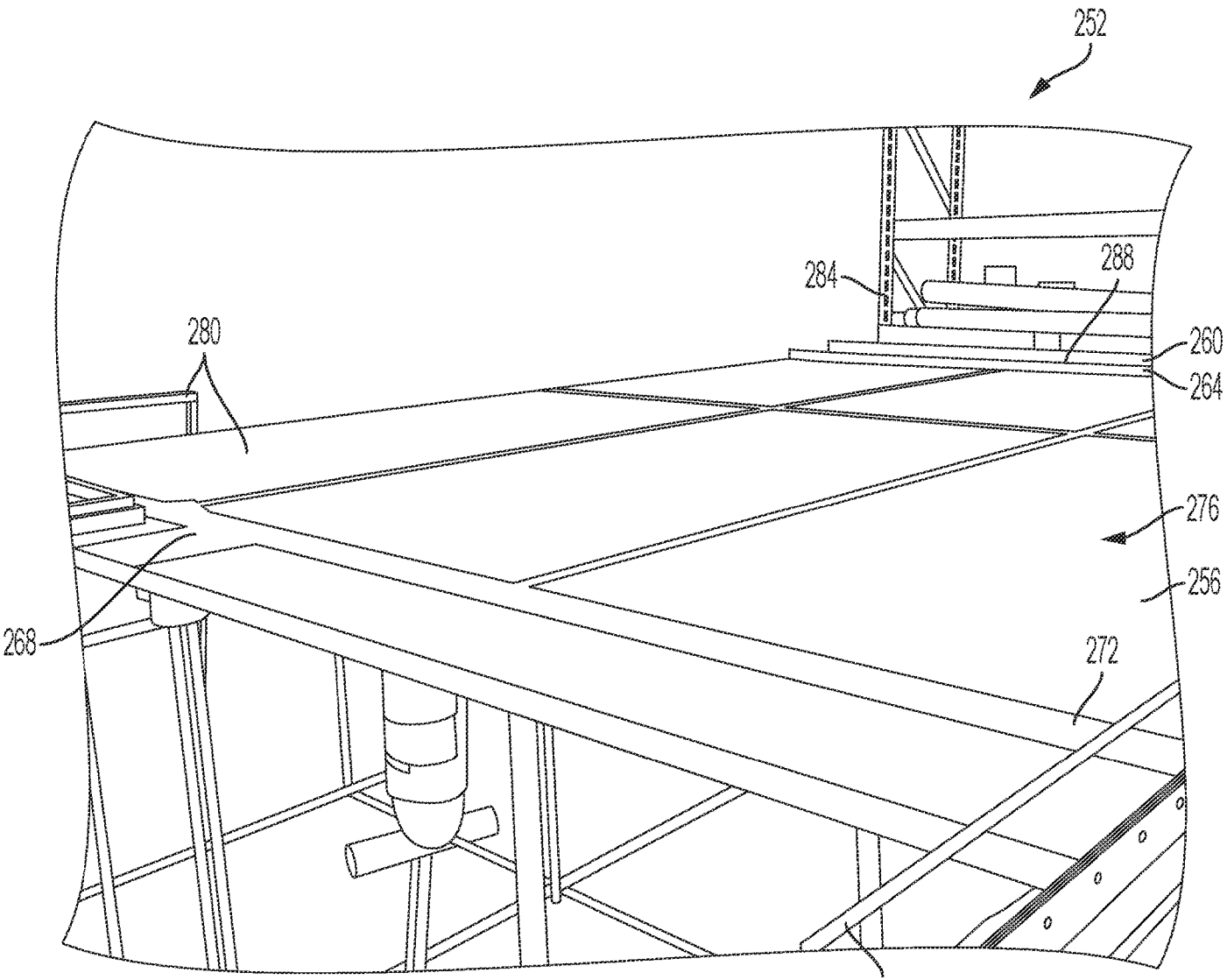
FIG. 16 illustrates a water flow test apparatus.
Figure 17:
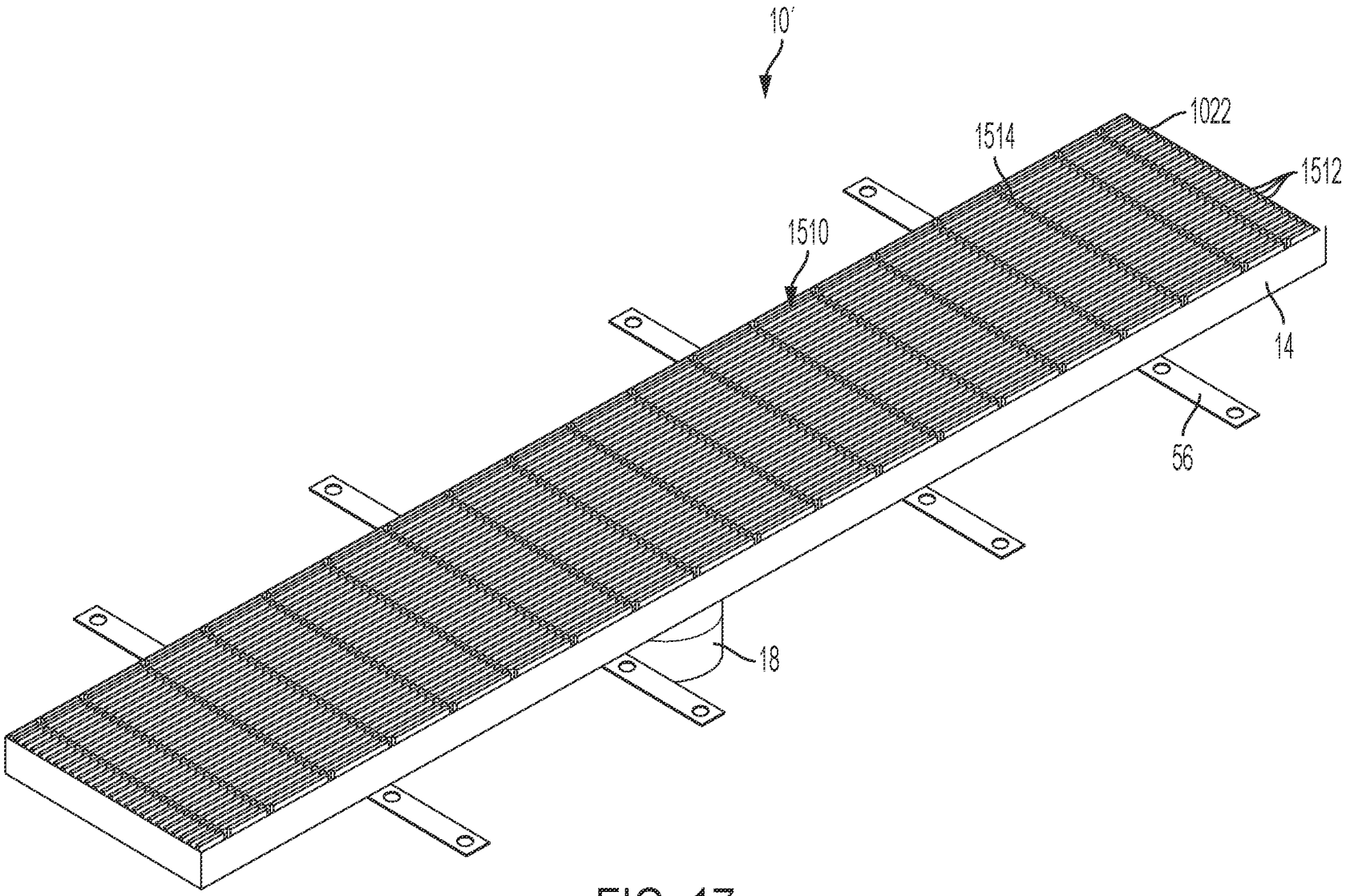
FIG. 17 is a perspective view of another embodiment of an elevator drain with another embodiment of a grate installed thereon.
Figure 18:
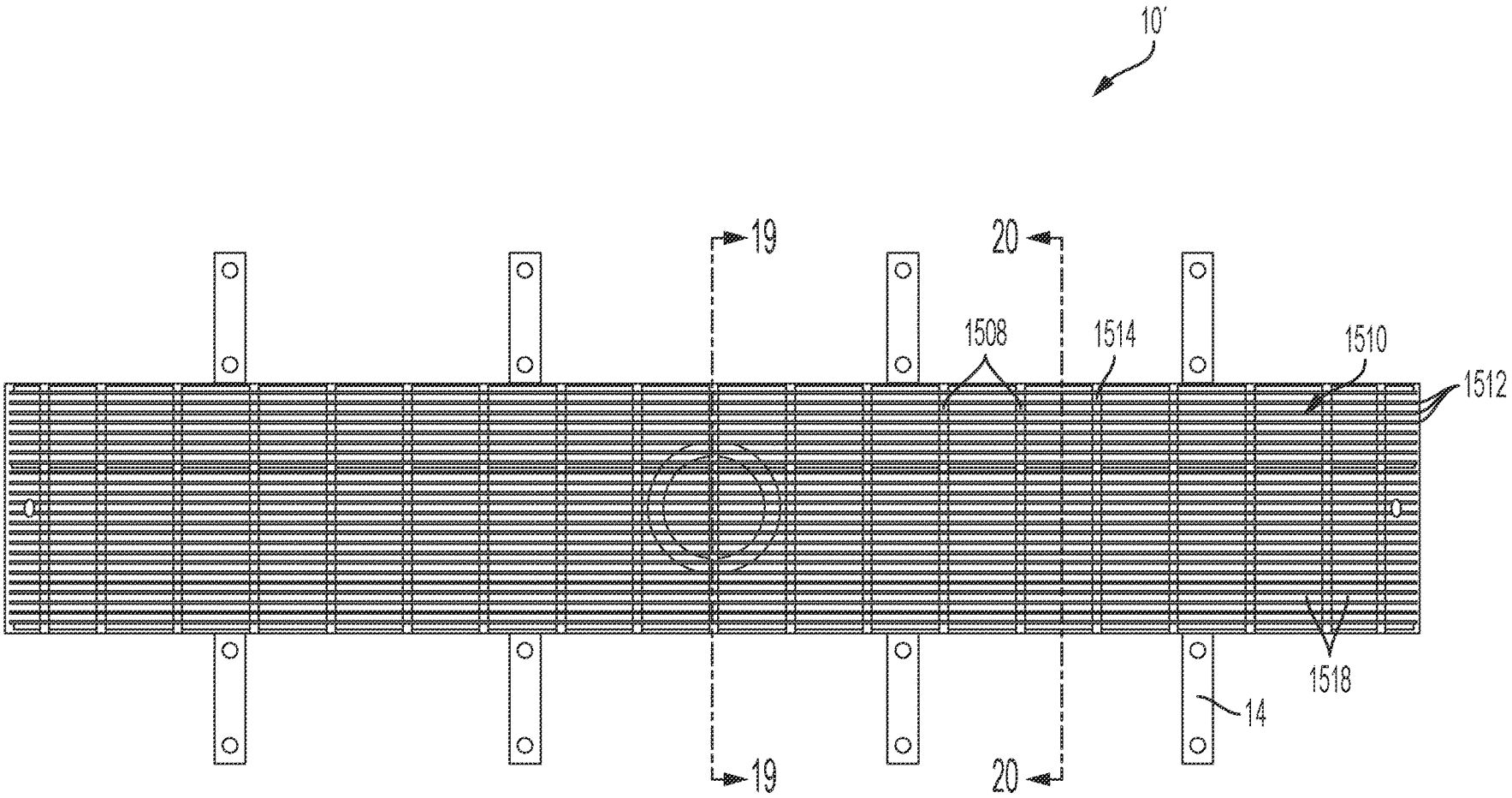
FIG. 18 is a top view of the elevator drain of FIG. 17.

To introduce the water into the drain 10 over only a single wall, the drain 10 is attached to a test stand 252 (see FIG. 16). The testing stand 252, in turn, includes a flow table 256, a flow generator 260 positioned proximate a first end 264 of the flow table 256, and connecting elements 268 positioned proximate a second end 272 of the flow table 256 opposite the first end 264 and configured to control the manner in which water is directed into the testing subject (e.g., the drain 10). During use, water is directed onto the flow table 256 by the flow generator 260 whereby the water flows across the table 256. Upon reaching the second end 272 of the table 256 the connecting elements 268 direct the flow toward and into the testing apparatus (e.g., the drain 10) in a predetermined manner.

The flow table 256 of the testing stand 252 generally includes a large planar surface 276 placed in a substantially horizontal orientation. The table 256 also includes one or more walls 280 couplable thereto to limit and direct the flow of water over the planar surface 276.

The flow generator 260 of the testing apparatus includes a vessel 284 into which water is pumped by the stand 252 at a predetermined volumetric flow rate. The flow generator 260 also includes a flow threshold 288 in fluid communication with the vessel 284 over which water flows onto the flow table 256. More specifically, in the illustrated embodiment, the vessel 284 fills with water from the pump until the water level reaches and overtakes the flow threshold 288 at which time the water spills over onto the first end 264 of the flow table 256. In the illustrated embodiment, the flow threshold 288 includes a substantially linear and horizontal edge extending substantially the entire width of the first end 264 of the table 256. By doing so, an even volume of water flows onto the table 256 over the entire width thereof. While the illustrated flow threshold 288 is both linear and substantially horizontal, it is understood that different features (e.g., notches, protrusions, curves, and the like) may be used to alter the manner in which water is directed onto the flow table 256, and as a result, flows over the planar surface 276.

The connecting elements 268 of the test stand 252 generally includes a series of walls, baffles, and brackets configured to locate the test item relative to the flow table 256 and influence the location(s) and manner in which the water interacts with the test item. In the illustrate embodiment, the connecting elements 268 are configured to orient the drain 10 so that the distal edge 34 of the front wall 30*a* is positioned vertically both below the planar surface 276 and immediately adjacent the second end 272. The connecting elements 268 also include a plurality of walls 292 that are configured to limit the flow of water so that water is only introduced over the front wall 30*a* and is not introduced over the side walls 30*c, d* nor the rear wall 30*b*. As shown in FIG. 16, this setup generally includes applying walls 292 to the side walls 30*c, d* directly to restrict the flow of water to that area of the drain's perimeter.

FIGS. 17-27 illustrate another embodiment of the drain 10'. The trench drain 10' includes the same trench 14 and conduit 18 as described above and another embodiment of a grate 1022. Only the differences between the drain 10' and drain 10 will be described herein.

The grate 1022 includes a first frame member 1500, a second frame member 1504 spaced a distance from and oriented substantially parallel to the first frame member 1500, a plurality of cross-members 1508 extending between the first frame member 1500 and the second frame member 1504, and a plurality of louvers 1512 supported by the cross-members 1508 to produce a support structure 1514 defining a top surface 1510. The resulting supports 1514 also defines a plurality of apertures 1518 through which water may flow into the drain volume 12.

The first frame member 1500 of the grate 1022 includes an elongated bar having a first end 1516, a second end 1520 opposite the first end 1516, and a bottom edge 1522 configured to rest against the base wall 36 of the trench 14. The first frame member 1500 also defines a plurality of notches 1524 spaced along the length thereof. Each notch 1524, in turn, is sized and shaped to at least partially receive and support a corresponding cross-member 1508 therein. In the illustrated embodiment, the notches 1524 are generally spaced evenly along the length of the member 1500 but in alternative embodiments, the notches 1524 may be unequally spaced as required.

Figure 19:
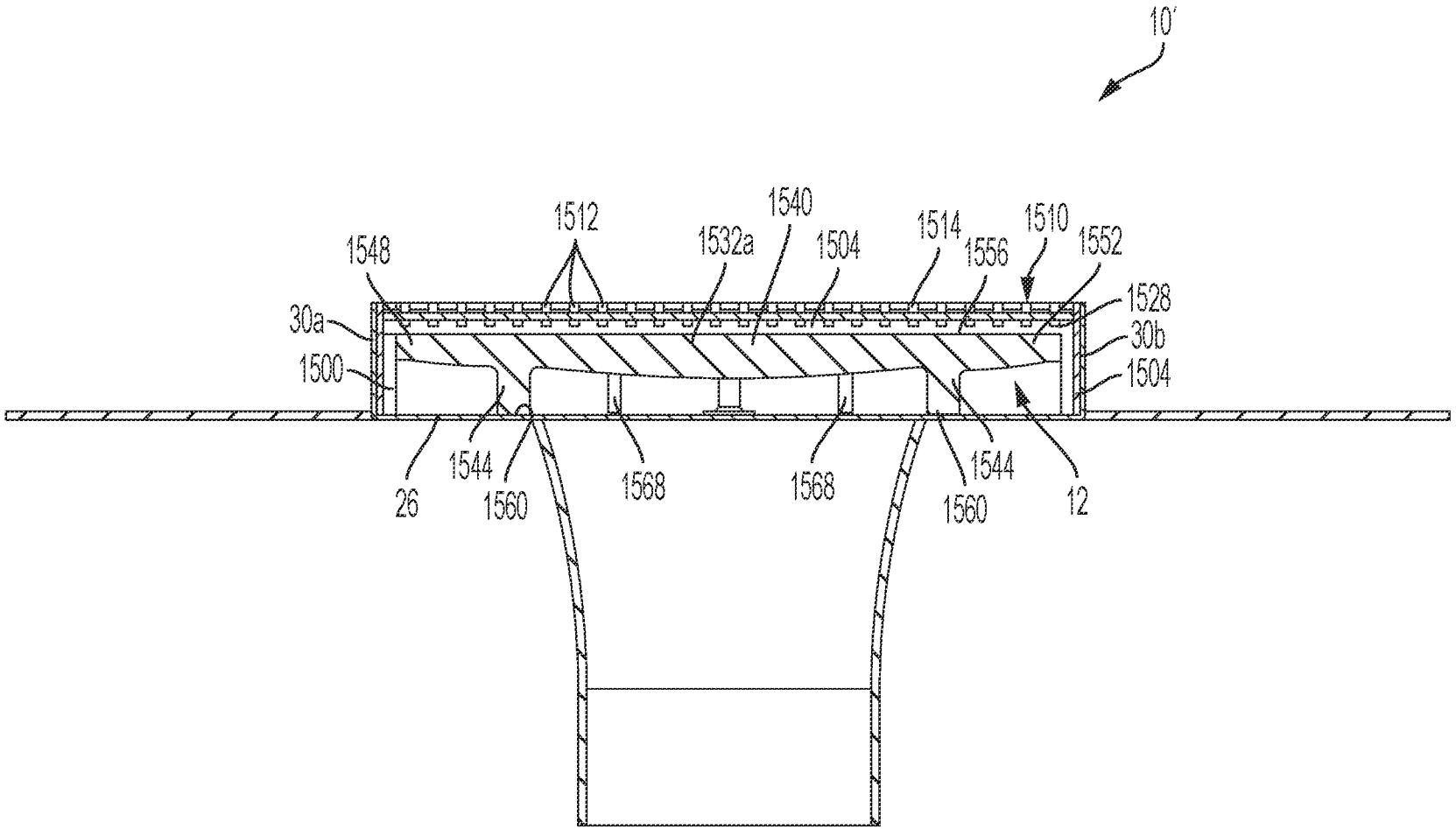
FIG. 19 is a section view taken along line 19-19 of FIG. 18.
Figure 20:
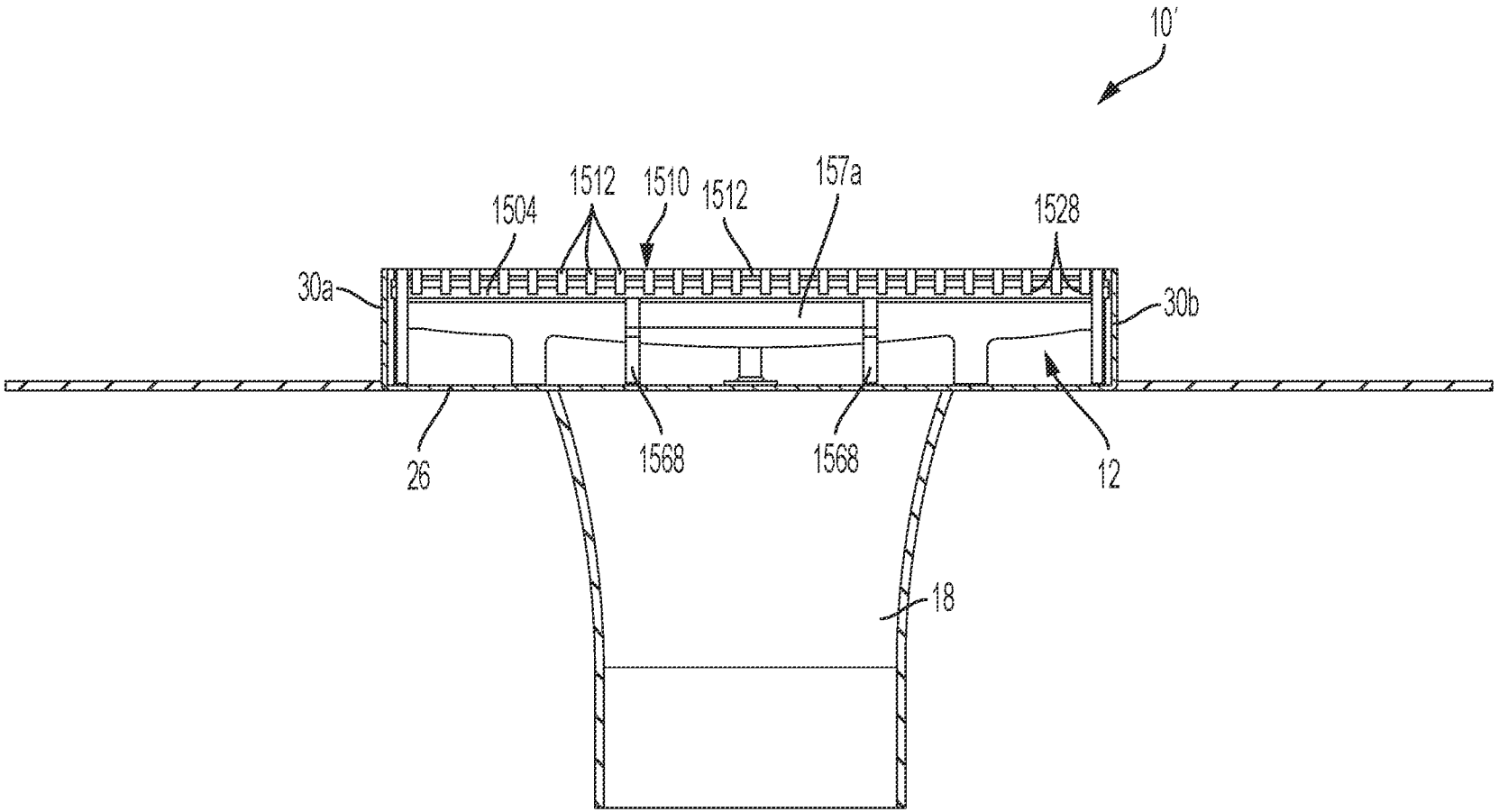
FIG. 20 is a section view taken along line 20-20 of FIG. 18.
Figure 21:
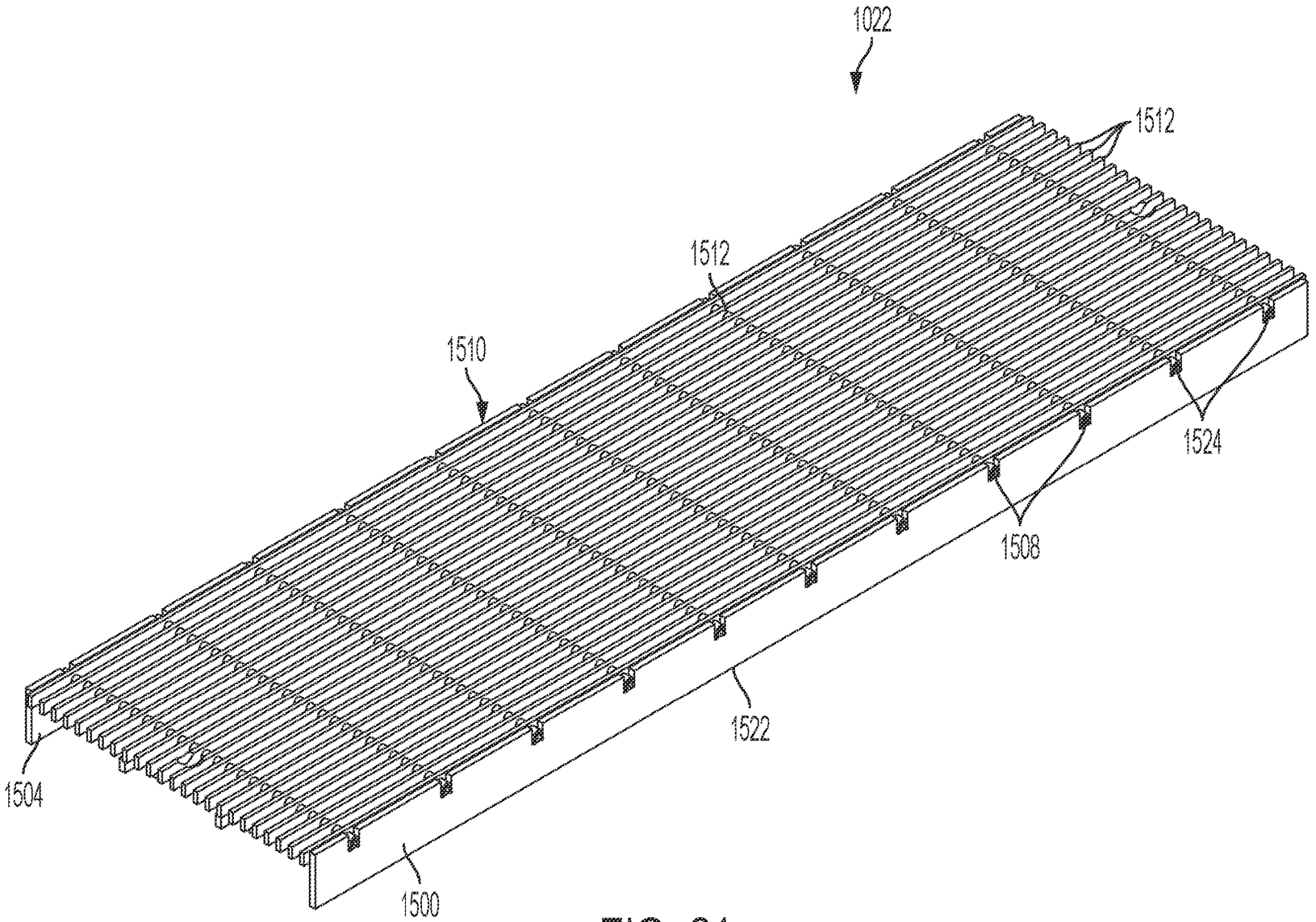
FIG. 21 is a perspective view of the grate of FIG. 17.
Figure 22:
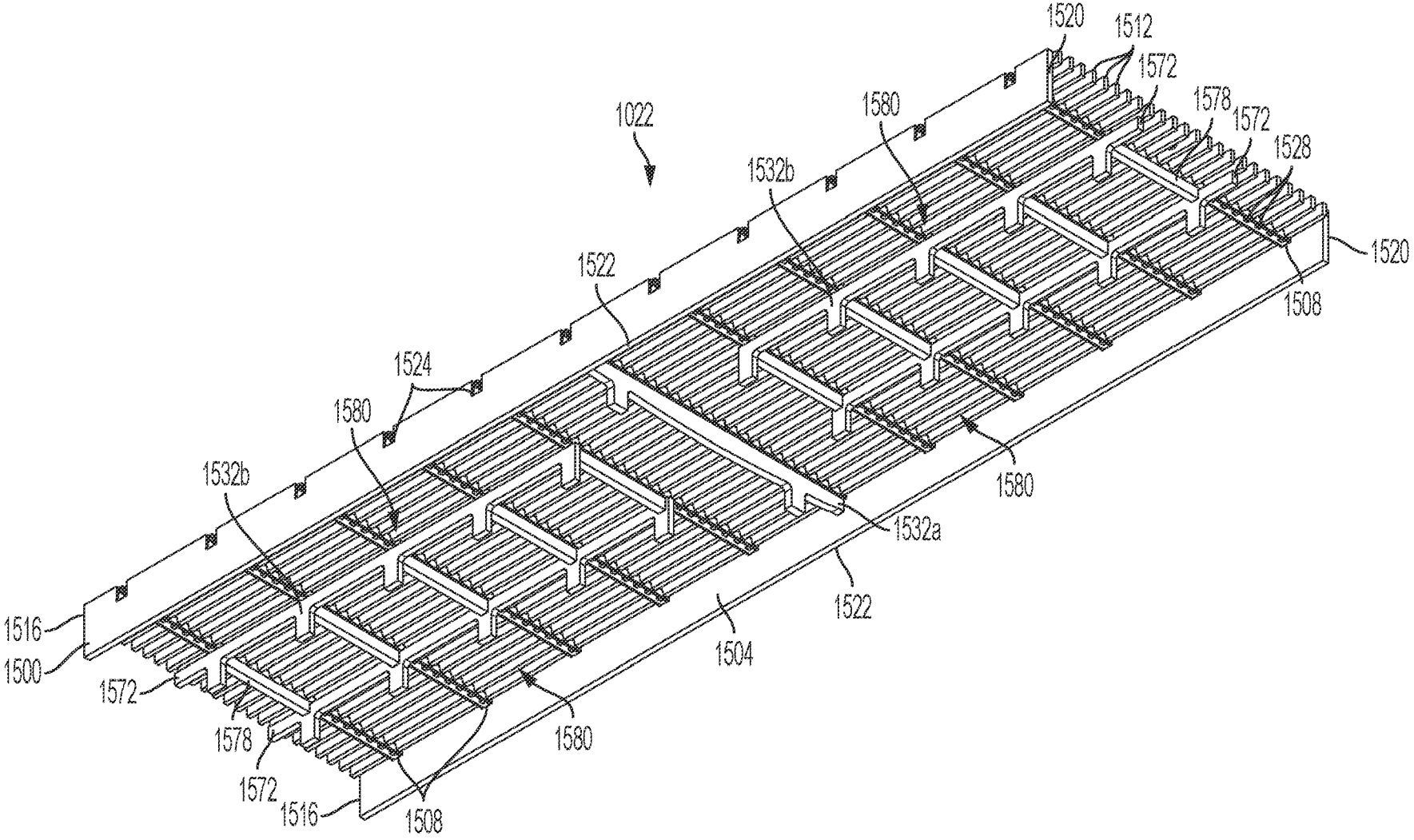
FIG. 22 is a bottom perspective view of the grate of FIG. 21.
Figure 23:
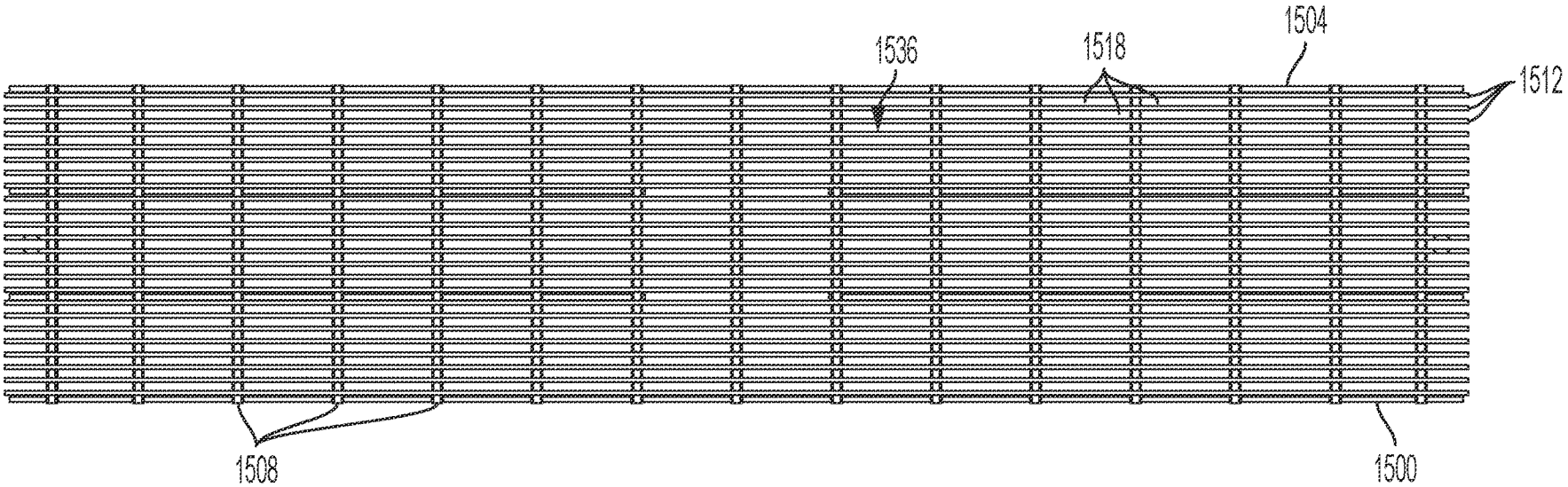
FIG. 23 is a top view of the grate of FIG. 21.
Figure 24:
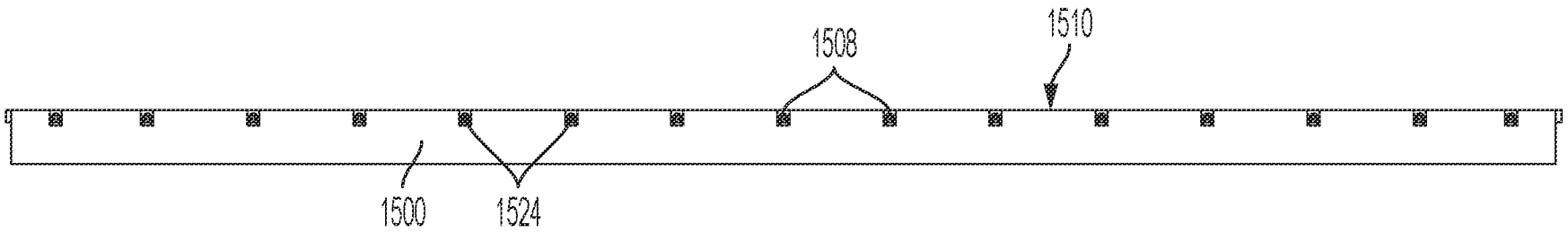
FIG. 24 is a side view of the grate of FIG. 21.

The cross-members 1504 of the grate 1022 are substantially elongated in shape having a substantially "V" shaped cross-sectional shape. As shown in FIG. 19, the cross-members 1504 also define a plurality of notches 1528, each of which are sized and shaped to receive at least a portion of a corresponding louver 1512 therein.

The louvers 1512 of the grate 1022 are substantially elongated in shape having a length that substantially corresponds with the length of the first and second frame members 1500, 1504. When the grate 1022 is assembled, the louvers 1512 are generally positioned so that they are extend parallel with the frame members 1500, 1504 while being supported by the notches 1528 of the cross-members 1504.

As shown in FIG. 19, the louvers 1512 are generally evenly spaced across the distance between the first and second frame members 1500, 1504.

The grate 1022 also includes one or more supports 1532*a, b* that, when the grate 1022 is installed in the trench 14, extend between the support structure 1514 and the base wall 36 to transmit loads therebetween. More specifically, each support 1532*a, b* includes at least one "foot" configured to contact the base wall 36 at an interior location grate 1022 (e.g., within the periphery thereof) and spaced a distance from the first and second frame members 1500, 1504. Stated differently, the first and second frame members 1500, 1504 enclose a grate region 1536 and the grate 1022 includes at least one support 1532*a, b* that is in contact with the base wall 36 at a location within the grate region 1536. In the illustrated embodiment, the grate 1022 includes a center support 1532*a* positioned proximate the conduit 18, and a pair of support frames 1532*b* on either side of the center support 1532*a*.

Figure 25:
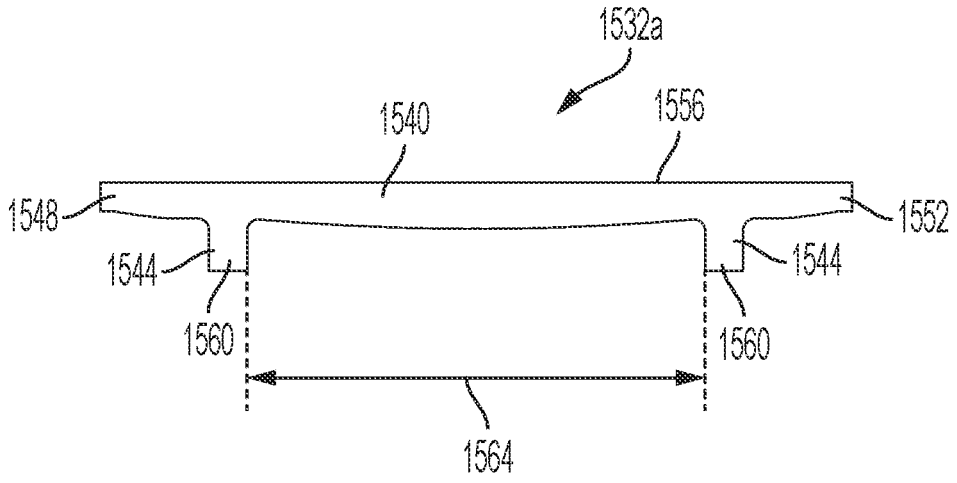
FIG. 25 is a detailed view of one embodiment of a support of the grate of FIG. 21.
Figure 26:
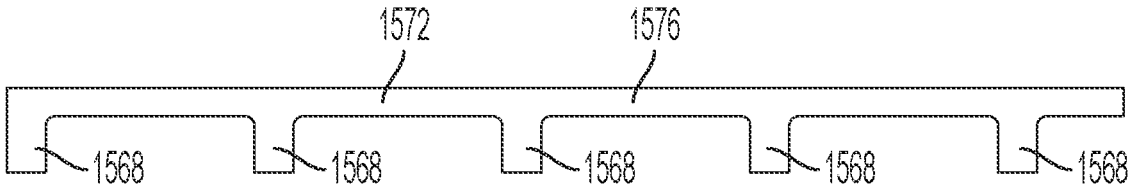
FIG. 26 is a detailed view of one embodiment of a support of the grate of FIG. 21.
Figure 27:
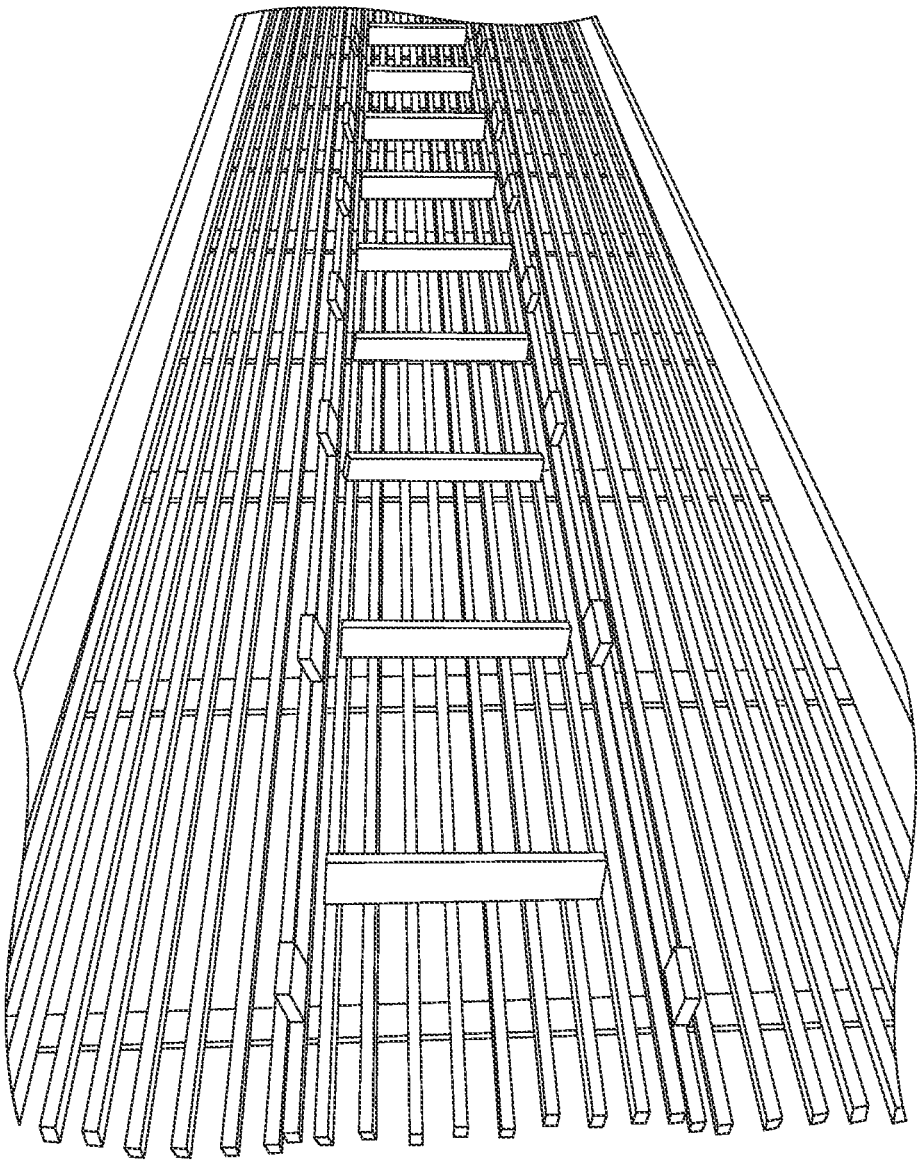
FIG. 27 is a bottom perspective view of one embodiment of a grate for use with the trench of FIG. 9.
Figure 28:
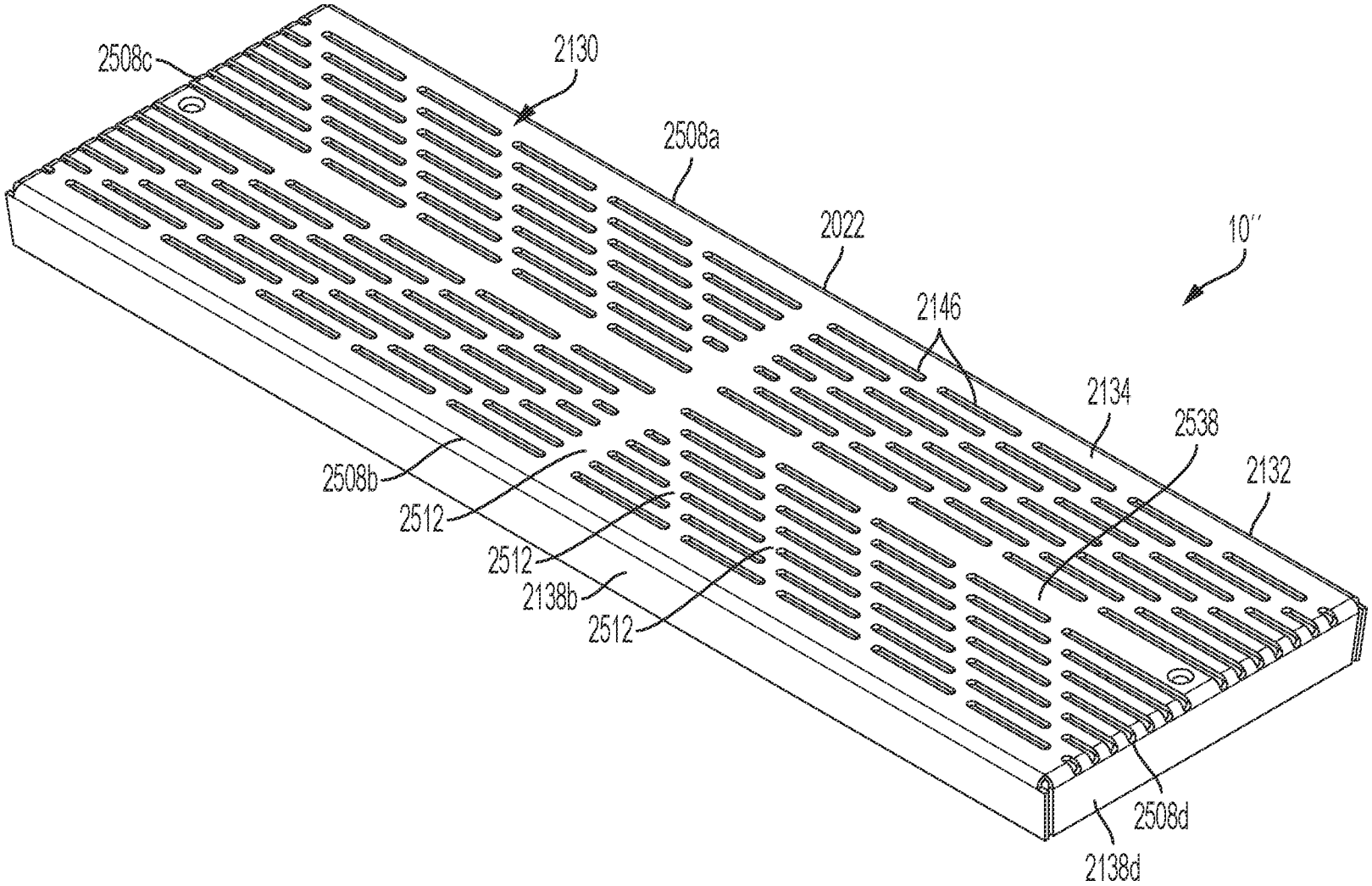
FIG. 28 is a perspective view of another embodiment of a grate for use with the trench of FIG. 9.

As shown in FIGS. 19 and 25, the center support 1532*a* includes a cross-member 1540 and a plurality (e.g., two) of feet 1544 extending downwardly from the cross member 1540 and configured to contact the base wall 36 when the grate 1022 is installed within the drain volume 12. The cross-member 1540 of the center support 1532*a* extends substantially the width of the trench 14 (e.g., the trench width 50) having a first end 1548 configured to engage the first frame member 1500, and a second end 1552 opposite the first end 1548 that is configured to engage the second frame member 1504. The cross-member 1540 also includes a top edge 1556 configured to engage and support at least one of the plurality of louvers 1512. By doing so, forces applied to the louvers 1512 proximate the center support 1532*a* are directed into the center support 1532*a* where the forces are directed into the base wall 36 via the two feet 186 (described below).

The feet 1544 of the center support 1532*a* extend downwardly from the cross-member 1540 to produce a distal end 1560 that, when the grate 1022 is installed, is configured to contact the base wall 36 of the trench 14. In the illustrated embodiment, the center support 1532*a* is positioned such that it extends across the opening of the inlet 86 of the conduit 18 (e.g., parallel and aligned with the minor axis 46) with each foot 1544 positioned just radially outside thereof. More specifically, the two feet 1544 of the center support 1532*a* define a gap 1564 therebetween that is equal to or larger than the inlet diameter 102 of the conduit 18.

Each support frame 1532*b* of the grate 1022 includes a rectangular array of feet 1568 each spaced from one another and extending between the louvers 1512 (e.g., the support 1514) and the base wall 36 to transmit forces therebetween. More specifically, each of the feet 1568 of the support frame 1532*b* are spaced apart from one another and the first and second frame members 1500, 1504, being located in the grate region 1536. In the illustrated embodiment, the frame 1532*b* includes a pair of support brackets 1572 interconnected by one or more ribs 1578 (see FIG. 22).

Each support bracket 1572 of the support frame 1532*b* includes an elongated cross-member 1576 and a plurality of feet 1568 extending from the cross-member 1576 along the length thereof. In the illustrated embodiment, each of the feet 1568 are equally spaced along the length of the cross-member 1576 although in alternative embodiments different layouts may be used.

When assembled together, the two support brackets 1572 produce a rectangular array of feet 1568 through which forces exerted upon the louvers 1512 may be transmitted into the base wall 36. Furthermore, when the support frame 1532*b* is installed within the grate 1022, the support frame 1532*b* produces two flow channels 1580 on either side thereof. The two channels 1580 extend between the center support 1532*a* and the distal end of the grate 1022 itself. As described above, each flow channel 1580, in turn, includes a region open to the inlet 86 of the conduit 18 where the drain volume 12 is completely un-obstructed vertically from the base wall 36 to the support plate 134.

Taken together, the center support 1532*a* and two support frames 1532*b* establish an array of supporting internal feet 1544, 1568 such that at least two feet 1544, 1568 will fall into a 3.5" reference circle placed anywhere within the periphery of the top surface 1510. While the illustrated grate 1022 is shown having two support frames 1532*b* and a central support 1532*a*, it is understood that in alternative embodiments more or fewer support frame 1532*b* may be present. In still other embodiments, a single support frame 1532*b* extending the entire length of the grate may also be used (see FIG. 2). In such embodiments, no central support 1532*a* may be present.

The trench drain 10 utilizing the above described grate 1022 is able to flow approximately 107 GPM. In other embodiments, the drain 10 with grate 1022 is able to flow between 105 GPM and 110 GPM. In still other embodiments, the drain 10 with grate 1022 is able to flow between 105.7 GPM and 108.4 GPM. The above described values may vary by approximately 1-2%.

In still other embodiments, the drain 10 with grate 1022 is able to flow approximately 107 GPM when the water is introduced into the drain 10 over a single wall (e.g., front wall 30*a*) and with a trench length 42 of 96 inches. For the purposes of this application, water being "introduced over a single wall" means that the water entering the drain 10 is only doing so by flowing over the distal edge 34 of only one of the four walls 30*a-d* of the drain 10 (e.g., the front wall 30*a*). As such, no water is being introduced over the distal edge 34 of the three remaining walls (e.g., the rear wall 30*b*, and two side walls 30*c, d*). In some embodiments, the drain 10 with grate 1022 is able to flow between 105 GPM and 110 GPM with water being introduce only over the front wall 30*a*. In still other embodiments, the drain 10 with grate 22 is able to flow between 105.7 GPM and 108.4 GPM with water being introduced only over the front wall 30*a*. The above described values may vary by approximately 1-2%.

FIGS. 28-32 illustrate another embodiment of the drain 10". The trench drain 10" includes the same trench 14 and conduit 18 as described above and another embodiment of a grate 2022. The grate 2022 is substantially similar to the grate 22 so only the differences will be discussed in detail herein.

The grate 2022 installable on the trench 14 and configured to enclose the open end 38 thereof while also providing a support structure 2534 with a top surface 2130 upon which a user or users may stand and place items or other loads while still permitting water to flow therethrough into the drain volume 12. The grate 2022 includes a support plate 2134 at least partially defining the top surface 2130 with a periphery 2132. The periphery 2132, in turn, includes a first edge 2508*a*, a second edge 2508*b*, a third edge 2508*c*, and a fourth edge 2508*d*.

The grate 2022 also includes a first perimeter wall 2138*a* extending from the periphery 2132 of the top surface 2130 (e.g., the first edge 2508*a*), a second perimeter wall 2138*b* extending from the periphery 2132 of the top surface 130 opposite the first perimeter wall 2138*a* (e.g., extending from the second edge 2508*b*), a third perimeter wall 2138*c* extending from the periphery 2132 between the first perimeter wall 2138*a* and the second perimeter wall 2138*b* (e.g., extending from the third edge 2508*c*), and a fourth perimeter wall 2138*d* opposite the third perimeter wall 2138*c* (e.g., extending from the fourth edge 2508*d*). In the illustrated embodiment, the perimeter walls 2138*a-d*, together, enclose a support region 2500 having a height defined by the height of the perimeter walls 2138*a-d* and a cross-sectional shape defined by the periphery 2132 of the grate 2022. While the illustrated grate 2022 is substantially rectangular resulting in four perimeter walls extending from four edges, it is understood that in alternative embodiments, the grate 2022 may include alternative shapes and sizes. Furthermore, in still other embodiments the perimeter walls may not be present for every edge of the periphery 2132.

Figure 30:
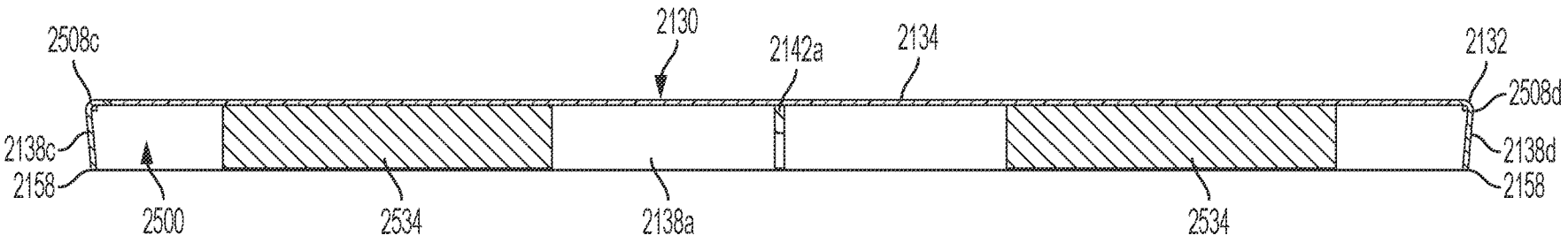
FIG. 30 is a section view taken along line 30-30 of FIG. 29.
Figure 31:
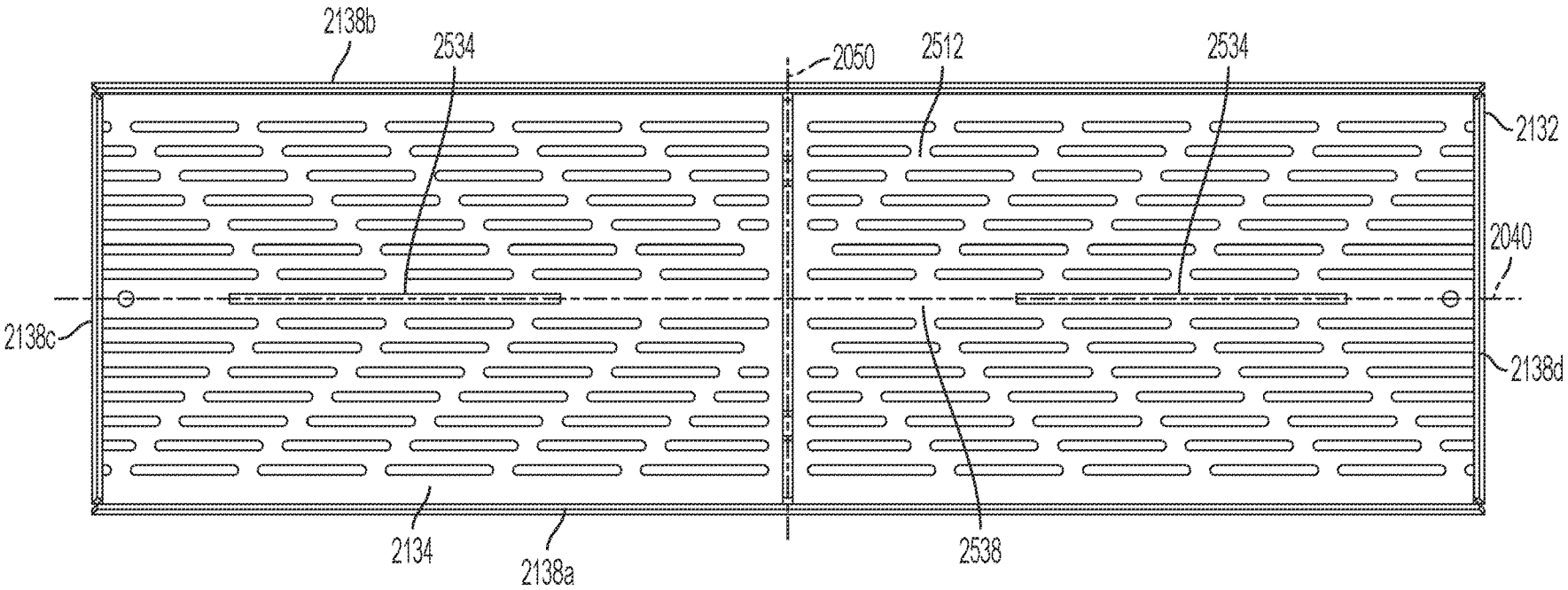
FIG. 31 is a bottom view of the grate of FIG. 28.
Figure 32:
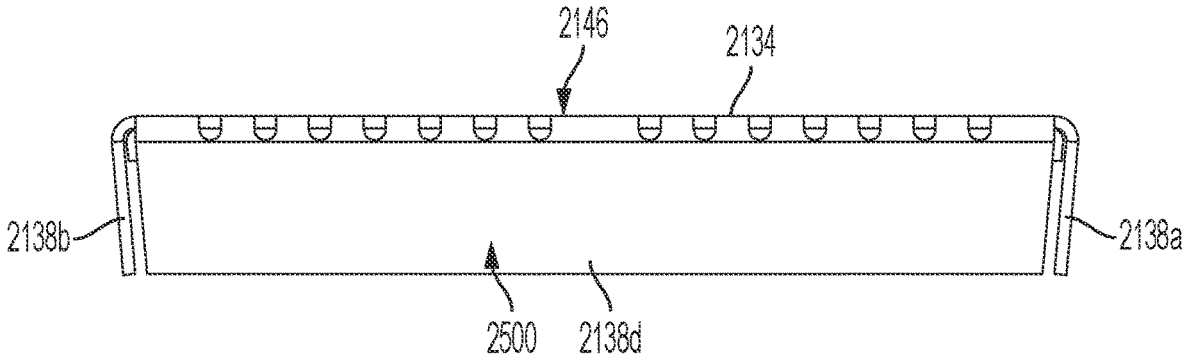
FIG. 32 is an end view of the grate of FIG. 28.

As shown in FIGS. 30 and 32, each perimeter wall 2138*a-d* of the grate 2022 is angled inwardly relative to the top surface 3130 so that the distal ends 2158 are positioned inwardly relative to the edges 2508*a-d* of the top surface 3130.

The grate 2022 also includes one or more supports 2534 configured to transmit forces between the support 2534 and the base wall 36. As shown in FIG. 30, the supports 2534 and located within the support structure region 2500. During use, the perimeter walls 2138*a-d* and supports 2534 are configured to elevate and position the top surface 2130 relative to the trench 14 while distributing any loads placed thereon into the floor 16 via the base wall 36.

Figure 29:
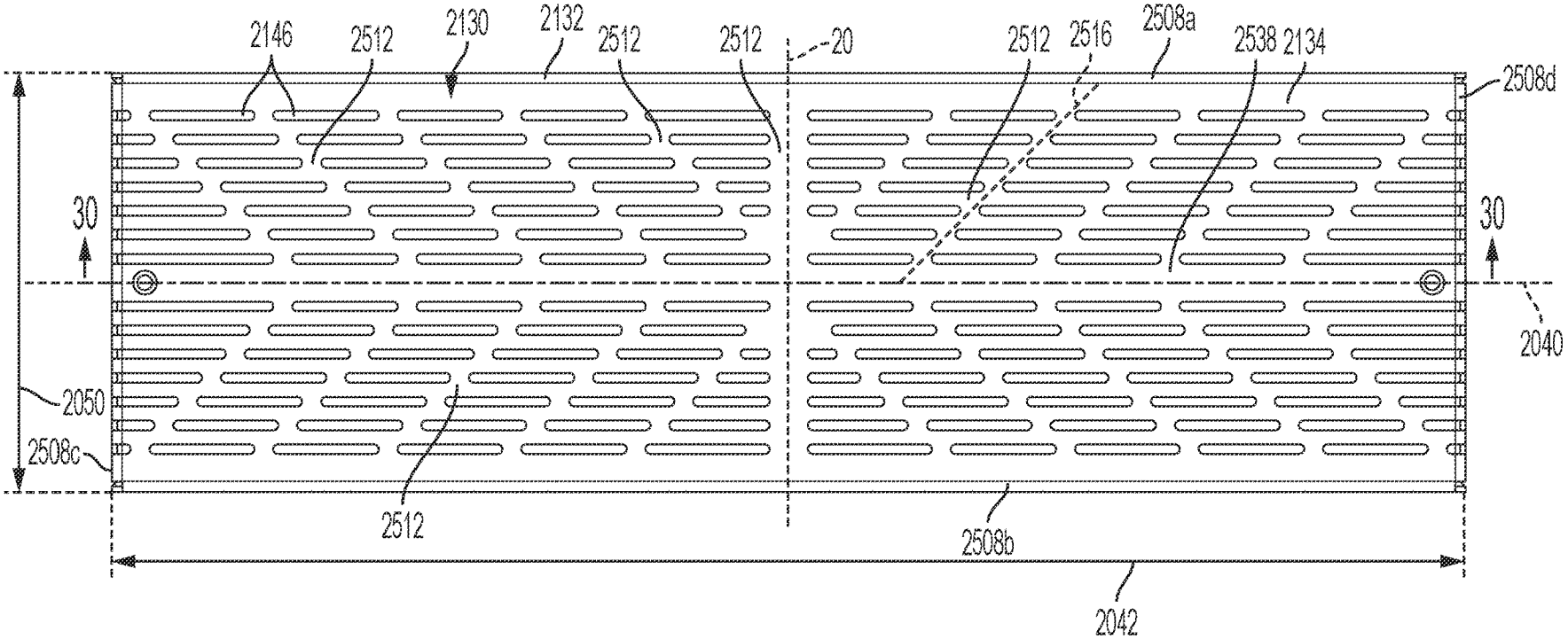
FIG. 29 is a top view of the grate of FIG. 28.

As shown in FIG. 29, the support plate 2134 of the grate 2022 defines a plurality of apertures 2146 sized and shaped with sufficient open area to permit a predetermined volume of water to pass through the support plate 2134 and into the drain volume 12 while minimizing the dimensions of the individual openings themselves so that various items (e.g., high heels, caster wheels, and the like) do not fall through or become stuck when passing over or stepping on the top surface 2130 itself. In the illustrated embodiments, the apertures 2146 are sized and shaped so that the resulting grate 2022 is both Americans with Disabilities Act (ADA) and Heel Proof certified.

The apertures 2146 of the support plate 2134 are positioned so that they produce a central spine region 2538 where no apertures 2146 are present. More specifically, the spine region 2538 extends along the entire length 2042 of the major axis 2040, extending between and continuous with the third edge 2508*c* and the fourth edge 2508*d* of the periphery 2132. Stated differently, a straight line may be drawn across the central spine region 2538 between the third edge 2508*c* and the fourth edge 2508*d* without intersecting an aperture 2146. In the illustrated embodiment, the central spine region 2538 is centered along the width 2050 of the support plate 2134.

As shown in FIG. 29, the apertures 2146 of the support plate 2134 are also positioned so that they produce one or more reinforcement regions 2512. Each reinforcement region 2512 includes a continuous region of material in the support plate 2134 that extends between one of the first or second edges 2508*a, b* and the central spine region 2538 without intersecting an aperture 2146. Stated differently, each reinforcement region 2512 includes a region of material in the support plate 2134 where a straight line axis 2516 may be drawn from an edge 2508*a, b* to the central spine 2538 without intersecting an aperture 2146. In the illustrated embodiment, the axis 2516 of some of the reinforcement regions 2512 are angled relative to the major axis 2040 to produce a "chevron" pattern pointing toward the center of the support plate 2134. However, in alternative embodiments the axis 2516 of the regions 2512 may be perpendicular to the first support region 2504*a*. In still other embodiments a combination may be present.

The supports 2534 of the grate 2022 extend between the support plate 2134 and the base wall 36 to selectively transmit loads therebetween. The supports 2534 may also serve as baffles to help direct and optimize the flow of water within the trench 14 during operation. More specifically, the supports 2534 of the grate 2022 includes a substantially planar baffle body that extends between the base wall 36 and the support plate 2134.

In the illustrated embodiment, each of the supports 2534 are oriented so that they are substantially parallel with the major axis 2040 of the grate 2022 and spaced a distance from the edges 2508*a, b* of the periphery 2132 (e.g., within the support region 2500) such that the support 2534 maximize the strength of the support plate 2134 and are configured to re-direct water that enters the trench 14 so that it flows toward the conduit 18. More specifically, the grate 2022 includes four supports 2534, with two placed on either side of the conduit 18. However, in alternative embodiments or more fewer supports 2534 may be present. The grate 2022 also includes a central 2142*a* as described above.

Figure 33:
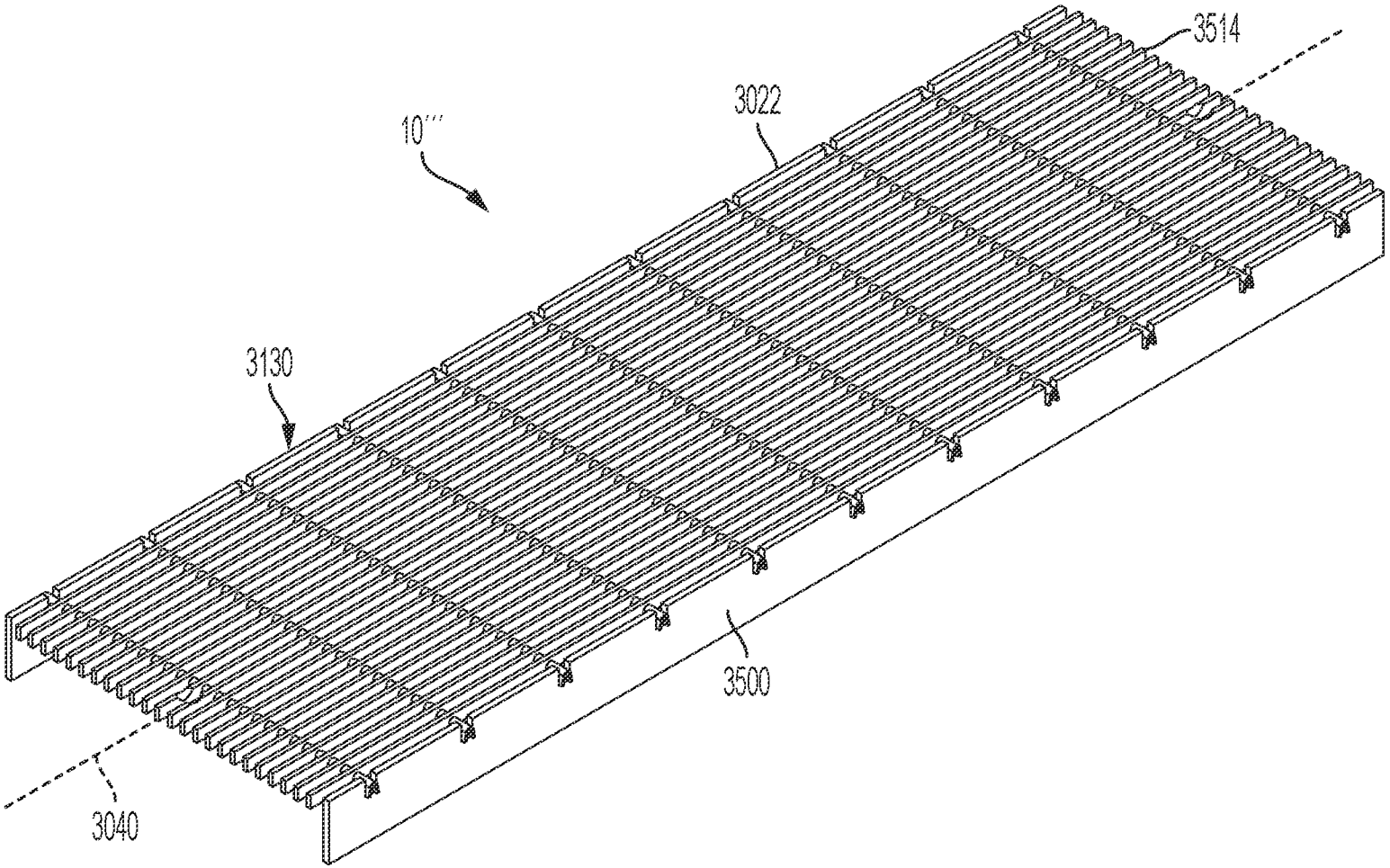
FIG. 33 is a perspective view of another embodiment of a grate for use with the trench of FIG. 9.
Figure 34:
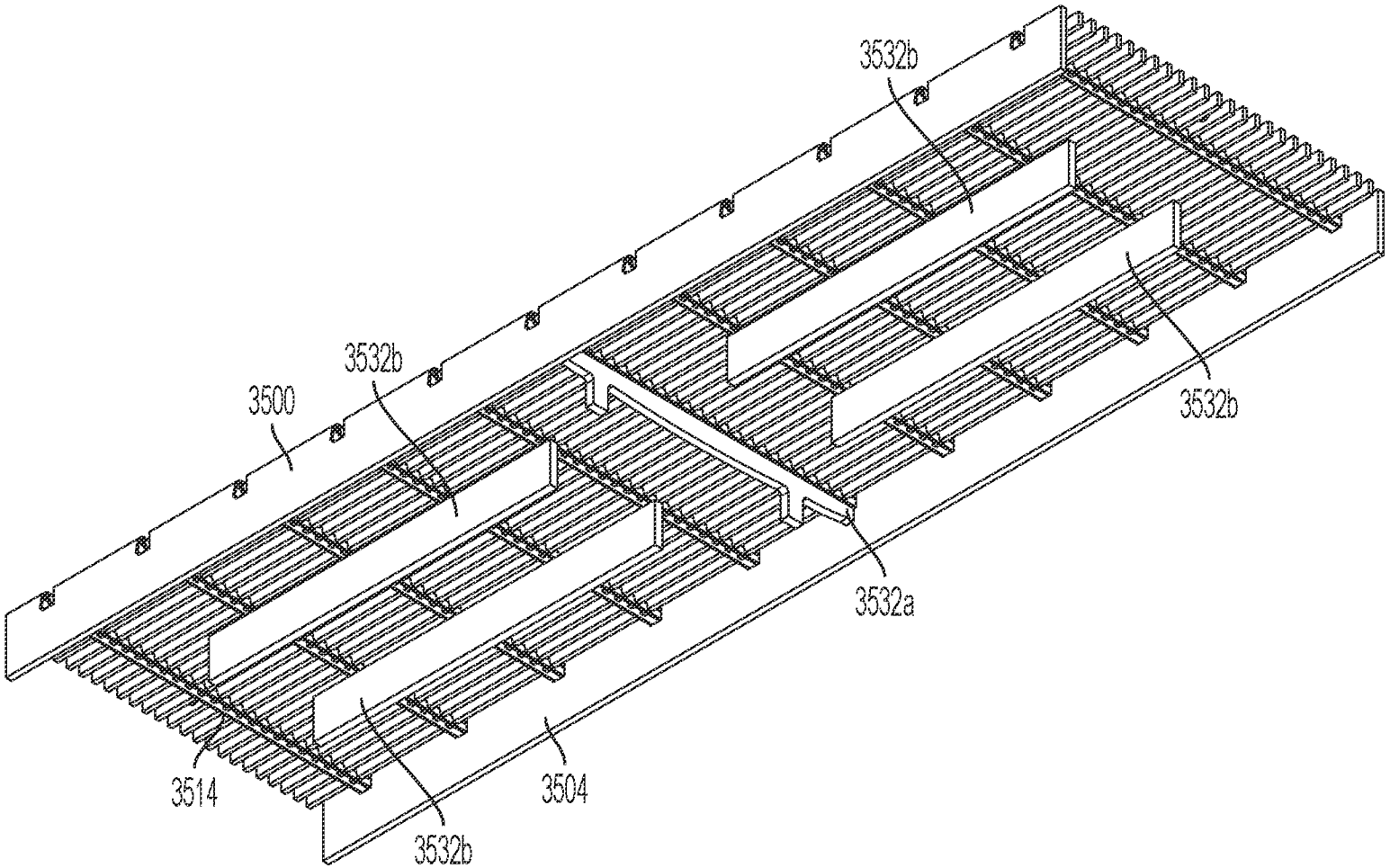
FIG. 34 is a bottom perspective view of the grate of FIG. 33.

FIGS. 33-34 illustrate another embodiment of the drain 10"". The trench drain 10"" includes the same trench 14 and conduit 18 as described above and another embodiment of a grate 3022. The grate 3022 is substantially similar to the grate 1022 of FIG. 17 and therefore only the differences will be described herein.

The grate 3022 includes one or more supports 3532*a, b* that, when the grate 3022 is installed in the trench 14, extend between the support structure 3514 and the base wall 36 to transmit loads therebetween. In the illustrated embodiment, the grate 3022 includes a center support 3532*a* positioned proximate the conduit 18, and a plurality of support frames 3532*b* on either side of the center support 3532*a*.

Each support frame 3532*b* of the grate 3022 includes a substantially planar plate that is configured to serve as both a structural support for the support structure 3514 and a baffle to help direct and optimize the flow of water within the trench 14. As shown in FIG. 33, the grate 3022 includes four support frame 3532*b* each oriented substantially parallel to the major axis 3040 of the grate 3022 and positioned between the frame members 3500, 3504. In the illustrated embodiment, the support frame 3532*b* are positioned in pairs, with two frames 3532*b* positioned on either side of the center support 3532*a*.

The invention claimed is:

1. An elevator trench drain comprising:

a trench at least partially defining a drain volume, wherein the trench includes a base wall and at least one side wall extending from the base wall;

a conduit coupled to the trench and open to the drain volume, wherein the conduit forms an opening in the base wall; and a grate coupled to the trench, wherein the grate includes:

a top surface defining a periphery, at least one wall extending from a periphery of the top surface and configured to contact the base wall of the trench, and a support, wherein the support includes a contact surface configured to selectively contact the base wall at a location inside the periphery of the top surface, wherein the contact surface is spaced a distance from the periphery to form a gap therebetween where the contact surface does not selectively contact the base wall.

2. The elevator trench drain of claim 1, wherein the top surface of the grate is defined by a plate defining at least one aperture therein.

3. The elevator trench drain of claim 1, wherein the top surface of the grate is defined by a plurality of louvers.

4. The elevator trench drain of claim 1, wherein the support is configured to selectively contact the base wall at a location spaced a distance from the wall.

5. The elevator trench drain of claim 1, wherein the support includes a substantially planar baffle extending between the top surface and the base wall.

6. The elevator trench drain of claim 1, wherein the grate defines a major axis, and wherein the support is substantially parallel to the major axis.

7. The elevator trench drain of claim 1, wherein the wall is a first wall, the elevator trench drain further comprising a second wall extending from the periphery of the top surface opposite the first wall, and wherein the support selectively contacts the base wall between the first wall and the second wall.

8. The elevator trench drain of claim 1, wherein the top surface defines a plurality of apertures therein, wherein the top surface defines a major axis, wherein the top surface forms a central spine region extending the entire length of the major axis, and wherein the top surface includes at least one reinforcing region extending between an edge of the periphery and the central spine region.

9. The elevator trench drain of claim 1, wherein the trench drain can flow 100 GPM.

10. The elevator trench drain of claim 1, wherein the grate is at least partially positionable within the drain volume.

11. The elevator trench drain of claim 1, wherein the support is configured to selectively transmit forces between the grate and the base wall.

12. An elevator trench drain comprising:

a trench having a base wall, wherein the trench at least partially defines a drain volume therein;

a conduit open to the drain volume via an opening in the base wall, the conduit defining an axis extending therethrough;

a grate including:

a top surface having a periphery and defining at least one aperture therethrough, a bottom surface opposite the top surface, and wherein when the grate is installed on the trench a grate depth is defined between the bottom surface and the opening in the base wall taken parallel to the axis, a first wall extending from the periphery and configured to contact the base wall, a second wall extending from the periphery opposite the first wall and configured to contact the base wall, and a support configured to selectively contact the base wall at a location between the first wall and the second wall, the support extending parallel to the axis a length substantially equal to the grate depth.

13. The elevator trench drain of claim 12, wherein the support includes a central support having a first foot configured to selectively contact the base wall and a second foot configured to selectively contact the base wall, and wherein the central support is positioned so it at least partially extends across an inlet of the conduit.

14. The elevator trench drain of claim 13, wherein the inlet of the conduit defines an inlet diameter, wherein the first foot is spaced a first distance from the second foot, and wherein the first distance is greater than the inlet diameter.

15. The elevator trench drain of claim 12, further comprising a plurality of supports each configured to transmit forces between the grate and the base wall, wherein each support includes a foot configured to selectively contact the base wall, and wherein the supports are distributed such that at least two feet fall into a 3.5" reference circle placed anywhere within the periphery of the top surface.

16. The elevator trench drain of claim 15, wherein the trench drain can flow 100 GPM.

17. The elevator trench drain of claim 12, wherein the grate is at least partially positionable within the drain volume.

18. The elevator trench drain of claim 12, wherein the support is configured to selectively transmit forces between the grate and the base wall.

19. An elevator trench drain comprising:

a trench at least partially defining a drain volume, the trench including a base wall;

a grate including a top surface defining at least one aperture therein;

a conduit open to the drain volume, wherein the conduit includes an interior surface at least partially defining a channel with a channel axis extending therethrough, wherein the channel defines a cross-sectional area taken normal to the channel axis, and wherein the cross-sectional area smoothly and continuously reduces from an inlet towards an outlet of the conduit, wherein the cross-sectional area of the conduit at the inlet is greater than the cross-sectional area of the conduit at all locations between the inlet and the outlet, and wherein the inlet of the conduit is continuous with the base wall; and wherein the inlet defines an edge transitioning between the base wall and the interior surface, wherein the edge defines a cross-sectional first radius taken along a plane parallel to the channel axis, and wherein the interior surface of the conduit defines a cross-sectional second radius taken along a plane parallel to the channel axis, and wherein the second radius is greater than the first radius.

20. The elevator trench drain of claim 19, wherein the interior surface has a convex cross-sectional shape taken parallel to the channel axis.

21. The elevator trench drain of claim 19, wherein the interior surface is parallel to the channel axis proximate the outlet.

22. The elevator trench drain of claim 21, wherein the interior surface is not parallel to the channel axis proximate the inlet.

23. The elevator trench drain of claim 19, wherein the trench defines a trench height, and wherein the trench height is no greater than 2.5 inches.

24. The elevator trench drain of claim 19, wherein the trench drain can flow at least 100 GPM.

25. The elevator trench drain of claim 1, wherein the conduit includes an opening that is formed by the base wall of the trench.

* * * * *